US011337526B2

(12) United States Patent
Gilchrist et al.

(10) Patent No.: US 11,337,526 B2
(45) Date of Patent: May 24, 2022

(54) CHAIR HAVING PLIABLE BACKREST AND METHODS FOR SAME

(71) Applicant: Cramer LLC, Kansas City, MO (US)

(72) Inventors: Kevin Gilchrist, Kansas City, MO (US); Kyle Michael Waggoner, Kansas City, MO (US); Jean-Francois Gomree, Minneapolis, MN (US); Nicholas M. Christianson, Fairway, KS (US)

(73) Assignee: Cramer LLC, Kansas City, MO (US)

( * ) Notice: Subject to any disclaimer, the term of this patent is extended or adjusted under 35 U.S.C. 154(b) by 0 days.

(21) Appl. No.: 17/072,516

(22) Filed: Oct. 16, 2020

(65) Prior Publication Data

US 2021/0030156 A1 Feb. 4, 2021

Related U.S. Application Data

(63) Continuation of application No. PCT/US2019/028301, filed on Apr. 19, 2019.

(Continued)

(51) Int. Cl.

| | |
|---|---|
| ***A47C 7/14*** | (2006.01) |
| ***A47C 7/44*** | (2006.01) |
| ***A47C 7/46*** | (2006.01) |

(52) U.S. Cl.

CPC ..... *A47C 7/462* (2013.01); *A47C 7/445* (2013.01)

(58) Field of Classification Search

CPC ..... A47C 7/029; A47C 7/282; A47C 7/445; A47C 7/462

(Continued)

(56) References Cited

U.S. PATENT DOCUMENTS 2,364,050 A * 12/1944 Benson ..... A47C 3/00 297/188.04
4,607,882 A * 8/1986 Opsvik ..... A47C 7/029 297/195.11

(Continued)

FOREIGN PATENT DOCUMENTS

CA 2953773 A1 * 6/2018 ..... A47C 9/002
DE 202013101342 U1 * 4/2013 ..... A47C 7/40

(Continued)

OTHER PUBLICATIONS

PCT Patent Application PCT/US2019/028301 International Search Report and Written Opinion dated Sep. 17, 2019.

*Primary Examiner* — Rodney B White
(74) *Attorney, Agent, or Firm* — Erise IP, P.A.

(57) ABSTRACT

A seating assembly includes a seat and an upright coupled with the seat. A pliable backrest is coupled with the upright and includes a support face and a coupling face. The pliable backrest includes a pliable material extending between the support and coupling faces. The support face is a first exterior face of the pliable back rest and the coupling face is a second exterior face of the pliable back rest. The coupling face is spaced away from the upright with a deformation gap. Another seating assembly includes a joint assembly along the upright member. The joint assembly includes a pivot configured to promote rotation of a first upright portion of the upright relative to a second upright portion. The joint assembly includes opposed stop interfaces configured to control rotation of the first upright portion relative to the second upright portion.

20 Claims, 26 Drawing Sheets

Related U.S. Application Data

(60) Provisional application No. 62/659,993, filed on Apr. 19, 2018.

(58) Field of Classification Search
USPC ..... 297/452.56, 296, 297
See application file for complete search history.

(56) References Cited

U.S. PATENT DOCUMENTS

D289,708 S * 5/1987 Rykken ..... D6/335
5,348,371 A 9/1994 Miotto
7,637,570 B2 * 12/2009 Becker ..... A47C 1/03274 297/314
7,665,805 B2 * 2/2010 Ueda ..... A47C 1/03255 297/301.6
7,712,833 B2 * 5/2010 Ueda ..... A47C 7/445 297/296
7,717,513 B2 * 5/2010 Ueda ..... A47C 7/443 297/300.2
7,862,120 B2 * 1/2011 Ueda ..... A47C 7/40 297/297
D673,397 S * 1/2013 Opsvik ..... D6/716.1
D673,398 S * 1/2013 Opsvik ..... D6/716.4
8,449,037 B2 * 5/2013 Behar ..... A47C 7/004 297/452.56
D692,247 S * 10/2013 Opsvik ..... D6/366
8,926,016 B2 * 1/2015 Behar ..... A47C 7/462 297/284.4
9,237,811 B1 * 1/2016 Cho ..... A47C 7/462
9,301,615 B2 * 4/2016 Behar ..... A47C 7/40
9,504,325 B2 * 11/2016 Sander ..... A47C 7/40
9,578,968 B2 * 2/2017 Masunaga ..... A47C 7/462
D781,606 S * 3/2017 Ngo ..... D6/366
10,021,985 B2 * 7/2018 Grove ..... A47C 7/462
10,058,180 B2 * 8/2018 Desanta ..... A47C 7/024
10,172,464 B2 * 1/2019 Cassaday ..... A47C 7/35
10,299,595 B2 * 5/2019 Diffrient ..... A47C 7/40
10,477,973 B2 * 11/2019 Gerbino ..... A47C 7/40
10,561,248 B2 * 2/2020 Grove ..... A47C 7/467
10,827,841 B1 * 11/2020 Tsai ..... A47C 7/402
10,945,529 B2 * 3/2021 O'Boyle ..... A47C 7/445
10,966,530 B2 * 4/2021 Masunaga ..... A47C 7/462
10,966,531 B2 * 4/2021 France ..... A47C 7/006
2003/0107252 A1 6/2003 Kinoshita et al.
2003/0151287 A1 * 8/2003 Ueda ..... A47C 7/462 297/301.1
2005/0236878 A1 10/2005 Rossetto et al.
2006/0076819 A1 4/2006 Burch
2007/0108831 A1 5/2007 Ueda
2008/0231095 A1 9/2008 Brauning
2009/0115235 A1 * 5/2009 Bock ..... A47C 7/462 297/284.7
2011/0012409 A1 1/2011 Bock
2011/0101748 A1 * 5/2011 Goetz ..... A47C 3/36 297/284.4
2012/0025575 A1 * 2/2012 Lin ..... A47C 3/34 297/311
2012/0056461 A1 3/2012 Donati
2014/0203618 A1 7/2014 Line et al.
2015/0265058 A1 * 9/2015 Igarashi ..... A47C 7/46 297/285
2016/0360892 A1 * 12/2016 Neil ..... A47C 7/282
2017/0231391 A1 * 8/2017 Desanta ..... A47C 7/445 297/297
2017/0311725 A1 * 11/2017 Grove ..... A47C 7/467
2017/0354254 A1 * 12/2017 Diffrient ..... A47C 1/024
2019/0365102 A1 * 12/2019 Kolberg ..... A47C 7/445
2020/0069064 A1 * 3/2020 Lee ..... A47C 7/462
2021/0244190 A1 * 8/2021 Mazlish ..... A47C 7/744

FOREIGN PATENT DOCUMENTS

EP 0970639 A1 * 1/2000 ..... A47C 7/462
EP 2818079 A1 12/2014
JP 3852677 B2 * 12/2006 ..... A47C 31/023
JP 2010063819 A * 3/2010 ..... A47C 7/462
JP 2010081974 A * 4/2010 ..... A47C 7/462
JP 2015013113 A * 1/2015 ..... A47C 7/462
JP 2019084337 A * 6/2019 ..... A47C 7/462

* cited by examiner

CHAIR HAVING PLIABLE BACKREST AND METHODS FOR SAME

RELATED APPLICATION

This application is a continuation of PCT Patent Application No. PCT/US2019/028301, filed Apr. 19, 2019, which claims the benefit of priority to U.S. Provisional Patent Application Ser. No. 62/659,993, filed Apr. 19, 2018, the disclosures of which are incorporated by reference in their entirety.

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves ail copyright rights whatsoever. The following notice applies to the software and data as described below and in the drawings that form a part of this document; Copyright Cramer, Inc.; Kansas City, Mo. All Rights Reserved.

BACKGROUND

Technical Field

This document pertains generally, but not by way of limitation, to seating assemblies.

Background

Seating assemblies used in offices, on work floors or the like provide a seat for a user to facilitate work at a desk, bench or the like. One example of a seating assembly used in an office setting includes a task chair having a plurality of castors connected with a support post, and a seat pan is connected with the support post. The task chair includes a backrest having a foam or upholstered lining affixed to a core or plate provided within or along the lining. The core or plate provides a rigid feature that maintains the lining in a specified shape and provides corresponding support to the back of a user. An upright affixed to the core or plate holds the backrest in a desired orientation relative to the remainder of the task chair.

In some examples, the backrest is coupled with the remainder of the seating assembly with a pivot or pivoting linkage, such as a spring biased hinge proximate to the seat pan. The upright extending from the backrest is coupled with the pivot. The user reclines in the task chair by leaning backward. The upright and the backrest including the lining and the core or plate rotate backward at relative degrees according to rotation at the pivot or linkage assembly proximate to the seat pan. Optionally, a hinge is provided between the backrest and upright to tilt the backrest relative to the upright.

Overview

The present inventors have recognized, among other things, that a problem to be solved includes restriction or limitation of organic anatomical movement in seating assemblies. For instance, task chairs include a backrest having a rigid core, frame, support plate or the like that supports and braces a back facing surface of the backrest, such as a cushion. The back rest is pivotally connected to a seat at one or more locations proximate to the seat pan or the backrest, and rotational movement of the backrest at the pivot roughly follows the back of a user in extension (backward) and flexion (forward) movements. In contrast, the spine of the user moves through articulation of a plurality of vertebrae. For instance, when moving in extension and flexion the spine curls as each of the moving vertebrae rotates relative to adjacent vertebrae. In effect, the spine moves in an articulating serpentine manner. Additionally, the user twists, rotates and generally moves between various orientations. However, the backrest of the seat assembly rotates through finite defined mechanical motion based on the pivotal connection (e.g., at a pivot or with a pivot linkage), and the profile of the backrest remains in an identical or near identical (i.e., with some deformation through the cushion) configuration throughout this motion because of the rigid core, frame, support plate or the like. The backrest fails to accurately follow the complex and organic articulating movement of the back of the user, and restricts or limits the articulating movement. These counter movements between the backrest and the user generate stress risers along the back and, in some examples, corresponding discomfort or pain.

The present subject matter helps provide a solution to this problem, such as by providing a seating assembly that includes a pliable backrest configured to follow the dynamic changing contour of the back. Instead of (or in addition to) the upright pivoting about a pivot point and substantially maintaining its profile during reclining, the pliable backrest is constructed with a pliable material from the support face (adjacent the back of the user) to one or more features of the backrest coupled with the upright, such as one or more pliable pillars. The pliable backrest is thereby remotely positioned relative to the upright, and the pliable material of the backrest is free to conform to the back of the user in initial (e.g., neutral) and deformed configurations of the seating assembly (e.g., while the user reclines or leans forward, twists, rotates or the like). A rigid core, frame, support plate or the like is not provided with the backrest, and accordingly the pliable material dynamically conforms to the changing back profile of the user including articulation of the back, twisting, rotation, tilting or the like. In another example, the pliable material of the pliable backrest between a supporting face and a coupling face (e.g., without an intervening plate, frame or the like) deforms to readily follow the articulating contour of the back of the user and provide support to the articulated back. The pliable backrest according facilitates the organic articulating movement of the back, in contrast to limiting or resisting such movement as in previous seating assemblies. Accordingly, both discomfort and pain are minimized with the example seating assemblies described herein. Additionally, other health benefits are realized with the example seating assemblies including, but not limited to, providing support to the back through the pliable backrest while at the same time promoting contraction and relaxing of the back muscles. For instance, even while passively-seated in the example seating assemblies (e.g., the neutral configuration) the back of the user is supported by the pliable backrest, but is not engaged (even indirectly) by a rigid frame or support coupled with a cushion. Instead, the back of the user is free to periodically adjust, move or the like for the comfort of the user (in a manner similar to periodic shifts is posture when standing still) because the pliable backrest organically conforms to the adjustments. In one example, this passive deformation (in contrast to deformation during reclining or affirmative movement) of the pliable backrest during adjustments by the user promotes blood circulation, and alleviates aches and inflammation.

The present inventors have further recognized, among other things, that another problem to be solved includes reducing labor intensive and hazardous assembly of seat assemblies. For instance, in at least some examples task chairs include a biasing element at a pivot, for instance proximate the seat pan. The biasing element provides a counter moment to rotation of the back rest through the finite and defined range of motion permitted by the pivot. Installation of the biasing element is accomplished in these examples with a fixture configured to hold the seat assembly in a static position. The biasing element is preloaded (e.g., compressed, wound or the like in a preloading fixture) to provide an initial bias to the element that predisposes the backrest toward an upright position. In the preloaded configuration the biasing element is installed in the statically held seat assembly. Once installed, the seat assembly is decoupled from the harness.

Preloading and installation of the biasing element are, in some examples, hazardous. The biasing element is held within a preloading fixture, preloaded, and then installed within the seat assembly. The potential energy within the biasing element is significant, and if released (e.g., with poor coupling to a fixture, with poor installation, or the like) may be hazardous to an operator. Additionally, a typical user, such as seat assembly owner, office manager or the like, does not usually have the equipment on hand to replace biasing elements or conduct repairs that require preloading and installation of the biasing element. Instead, the seat assembly is serviced onsite by a visiting repair technician, or the seat assembly is shipped to a repair shop for offsite service.

The present subject matter helps provide a solution to this problem, such as by providing a seating assembly that preloads the biasing element during assembly of the seating assembly. In one example, the biasing element is positioned in a base housing of the seating assembly in an unloaded configuration. For instance, the biasing element is interposed between a proximate element anchor of the base housing and a pivot. The pivot is optionally included with an upright bracket rotatably coupled with the base housing. A seat pan is coupled with the base housing and spaced from the base housing in a passive preloading configuration.

The seat pan is spaced from the base housing by the upright bracket and the biasing element. The seat pan is then fastened to the base housing, for instance screws, bolts, clamps or the like are tightened between the seat pan and the base housing. Fastening compresses the space between the seat pan and the base housing and automatically preloads the biasing element to a preloaded configuration (e.g., a specified initial preload).

The biasing element is positioned in the seating assembly before preloading. Coupling of the seating assembly with the base housing and compressing of the spacing therebetween anchors (e.g., captures, holds, retains or the like) the biasing element in place while it is deflected for preloading. Unexpected release of the biasing element during preloading is accordingly minimized (e.g., eliminated or reduced). Instead, the seating assembly surrounds and thereby captures the biasing element in place between a passive preloading configuration (at initial coupling) and the preloaded configuration. Further, if maintenance or service is needed the operator may unfasten and decouple the seat pan from the base housing (e.g., through release of screws, bolts or clamps) to gradually unload the biasing element and service the biasing element in an unloaded configuration. The operator may-then service and replace parts in the seating assembly without a technician appointment or shipping of the seating assembly to a technician shop.

This overview is intended to provide an overview of subject matter of the present patent application. It is not intended to provide an exclusive or exhaustive explanation of the disclosure. The detailed description is included to provide further information about the present patent application.

BRIEF DESCRIPTION OF THE DRAWING FIGURES

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
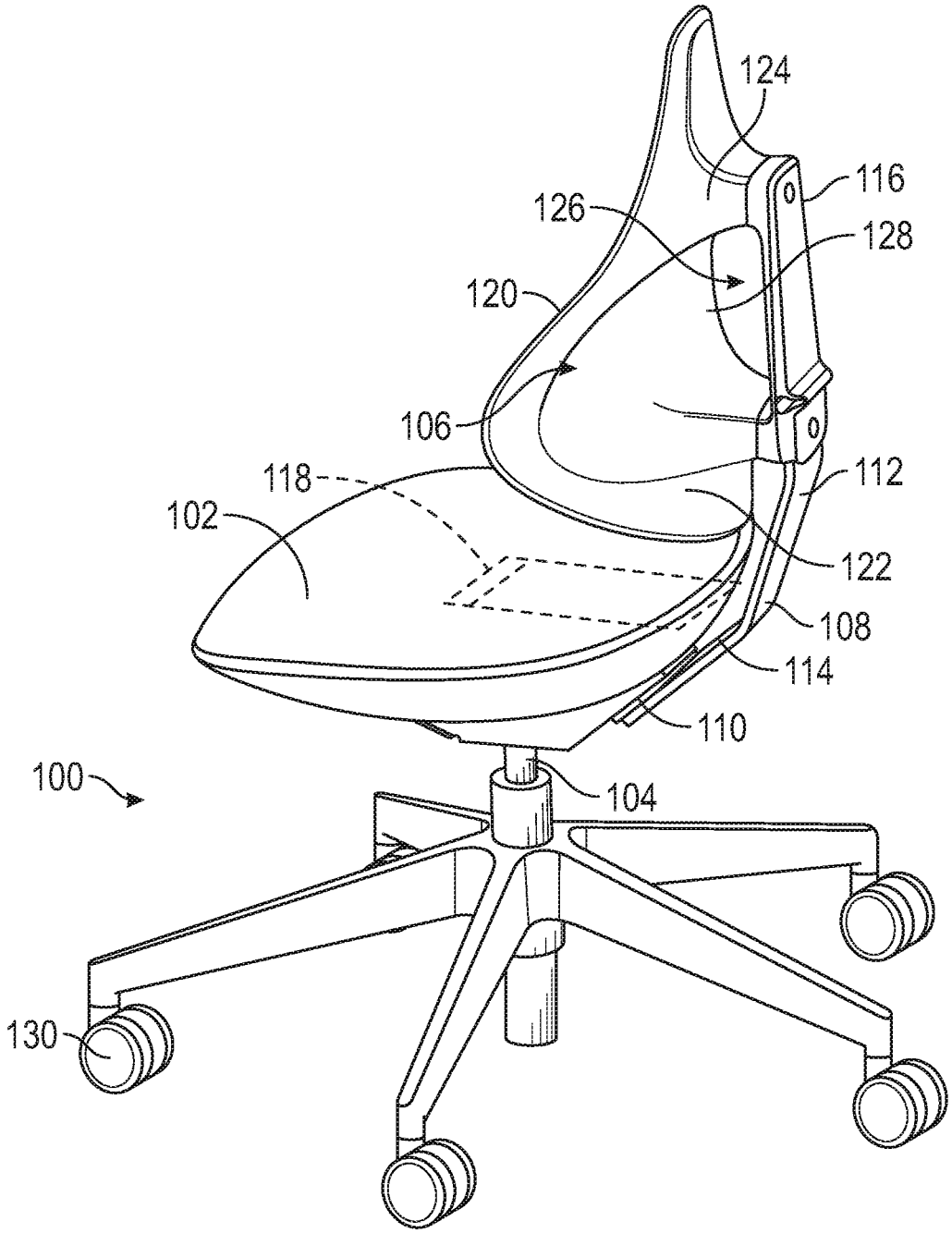
FIG. 1 is a perspective view of one example of a seat assembly including a pliable backrest.

FIG. 1 shows a perspective view of a seating assembly 100. The seating assembly 100 includes a seat 102 having a seat pan and an underlying frame (e.g., a base housing) coupled with a support post 104. As shown in FIG. 1, the support post 104, in this example, extends to a lower frame, one or more castors 130 or the like providing rolling support to the seating assembly 100. The seating assembly 100 further includes a pliable backrest 106 coupled with the remainder of the seating assembly 100 with an upright member 112.

As described herein, the seating assembly 100 includes one or more features configured to provide additional functionality to the seating assembly 100 for the support, comfort and flexibility of use for an occupant. For instance, as described herein, the seating assembly 100 includes a pliable backrest 106 configured to provide deflectable support for the upper and lower back of the occupant. As further described herein, the seating assembly 100 includes an optional joint assembly configured to cooperate with the pliable backrest 106 and facilitate deflectable movement of a portion of the upright 108 (e.g., a second upright end portion 116 relative to a first upright end portion 114).

In another example, the seating assembly 100 includes an upright bracket 110 pivotally coupled with the remainder of the seating assembly 100, for instance, the frame of the seat 102 such as a base housing at a pivot hub 118. As described herein, in one example the upright bracket 110 is assembled with the remainder of the 102 to provide an automatic preloaded bias to one or more elements, such as bias elements including bias struts (e.g., leaf springs, coil springs, torsion springs, elastomeric elements or the like) coupled with the upright bracket 110 and the remainder of the seat 102, for instance a seat pan and a base housing associated with the underside of the seat 102.

Referring again to FIG. 1, the pliable backrest 106 is shown with a support face 120 and a coupling face 122. In one example, the support face 120 is configured to support and engage with the back of the occupant while the coupling face 122 is coupled with one or more components of the upright 108, for instance, the upright member 112, As shown in FIG. 1, in this example, the coupling face 122 of the pliable backrest 106 is coupled with the upright member 112 with one or more pliable pillars 124. In the example shown the pliable backrest 106 is coupled with the upright member 112 at two pliable pillars 124 located intermediately relative to the lateral wings 200 shown of the pliable back rest 106 (see FIGS. 2A, B). A support span 128 extends between the pliable pillars 124 and accordingly provides a deformation gap 126 configured to receive deformable portions of the pliable backrest 106 therein to facilitate the deformation of the pliable backrest 106 during movement of the occupant.

Figure 2A:
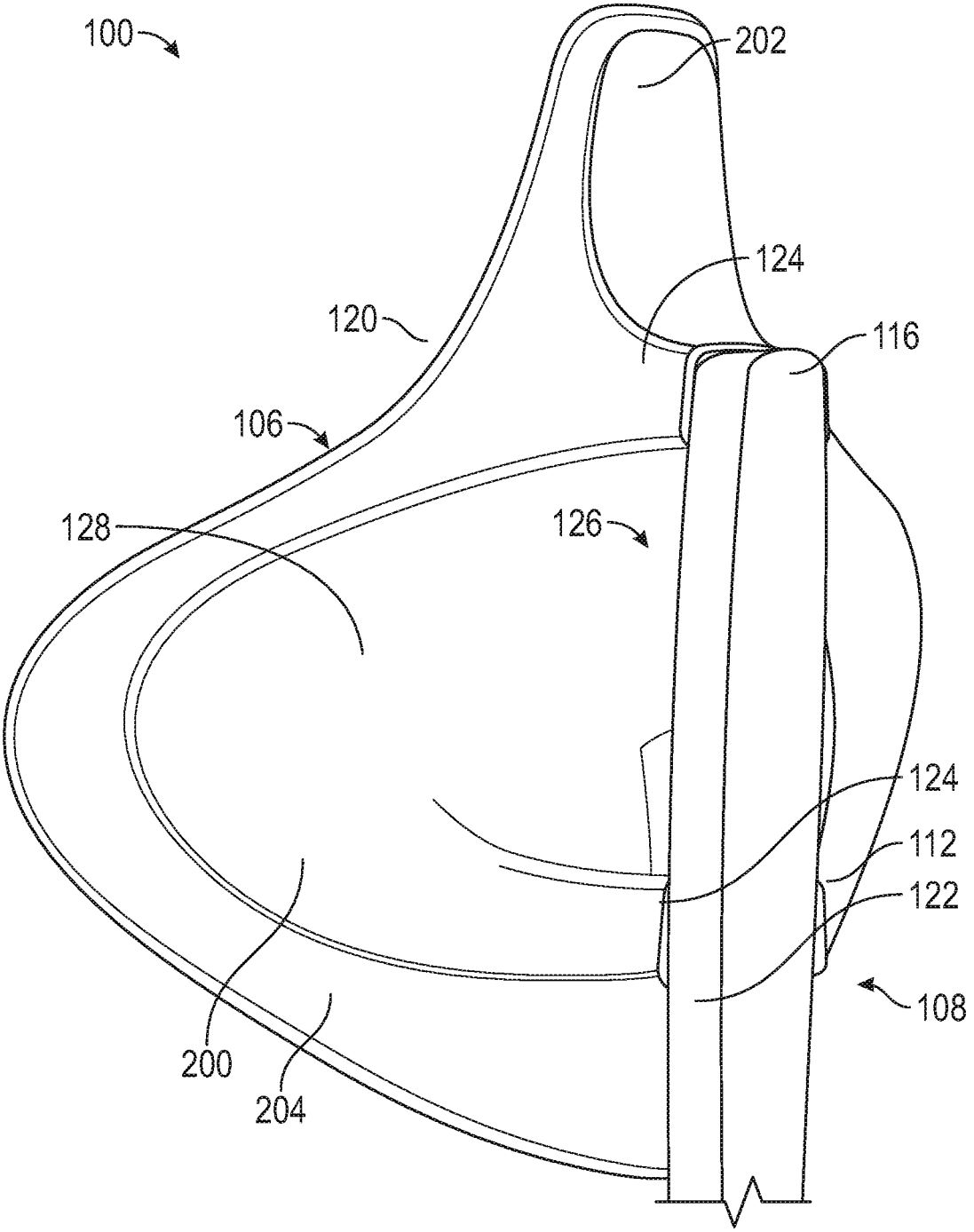
FIG. 2A is a perspective view of another example of a seat assembly including a pliable backrest.

FIG. 2A shows a detailed view of the pliable backrest 106 and another example of the upright member 112. In this example the upright member 112 does not include a joint assembly, for instance, a deflectable joint assembly having a pivot, stop or the like as described elsewhere herein and shown by example in FIG. 2B. Referring again to FIG. 2A, the pliable backrest 106 includes lateral wings 200, for instance, left and right lateral wings 200 and an optional vertical wing 202 extending upwardly from the remainder of the pliable backrest 106.

As further shown in FIG. 2A and previously described herein, the pliable backrest 106 includes one or more pliable pillars 124 (two in this example) extending from the pliable backrest 106 as portions of the coupling face 122 for coupling with the upright member 112. The pliable pillars 124 space the remainder of the pliable backrest 106 from the upright member 112 and accordingly provide a deformation gap 126 therebetween. The pliable materials of the pliable backrest 106, facilitate the deformation of the backrest and accordingly impart flexibility for conformation to the back of the occupant and deformation with movement of the occupant to facilitate occupant support at the lower and upper back portions of the occupant while seated and during movement in the seating assembly 100. For example, during one or more of reclining, tilting (e.g., tilting forward with the lower back seated against the support face 120) lateral twisting or the like the pliable backrest 106 pliably conforms to the back of the occupant in corresponding postures for these movements while also providing support.

The pliable material of the pliable backrest includes a deformable material configured to deflect and conform to the back of the occupant as the occupant moves in the seating assembly. In examples, the pliable material includes, but is not limited to, foamed polymers, gel based foams or the like. In one example, the pliable material includes a polyurethane foam, a polyurethane skinned foam or the like. In another example, the pliable material includes a molded polymer part including a polymer configured to deform and accordingly conform to the anatomy of the occupant in the seating assembly (e.g., while sitting, during reclining, tilting, twisting or the like). For instance, a pliable backrest 106 including polyurethane configured to deform (while also supporting the occupant) and having an elastic strain limit that permits deflection without deformation, failure or the like.

Referring again to FIG. 2A, as shown, the pliable backrest 106 includes an optional pliable frame 204 extending around the pliable backrest 106. The pliable frame 204 extends around a perimeter, periphery or the like of the pliable backrest 106. The pliable frame 204 is constructed with the material of the remainder of the pliable backrest 106, in one example. The pliable frame 204 has enhanced thickness, width or the like relative to one or more portions of the pliable backrest 106 (e.g., relative to the remainder of the lateral wings 200). Accordingly, the pliable frame 204 supports the lateral wings 200, vertical wings 202 or the like configured to deform and support one or more postures or movements of the occupant including, for instance, twisting movement, reclining movement or the like.

In another example, the pliable backrest 106 includes a consistent material from the support face 120 to the coupling face 122. For instance, in one example, the pliable backrest 106 includes a foamed elastomer including a foamed rubber, deformable polymer or the like configured to depress and deform from the support face 120 to the coupling face 122. In one example, the pliable material of the pliable backrest 106 extends from the support face 120 to the interface with the upright member 112 of the upright 108. For instance, one or more of the pliable pillars 124 includes the pliable material and accordingly the pliable backrest 106 provides a consistent material between each of the support face 120 and the upright member 112, Accordingly, the pliable backrest 106 is configured to readily deform, deflect or the like without an intervening rigid framework, panel or the like coupled with the backrest. Instead, the pliable material of the pliable backrest 106 provides deformable support to the pliable backrest 106 to facilitate the deformation of the pliable backrest 106 during reclining, tilting, twisting, movement or the like while conforming to the contour and supporting the contour of the back of the occupant.

Figure 2B:
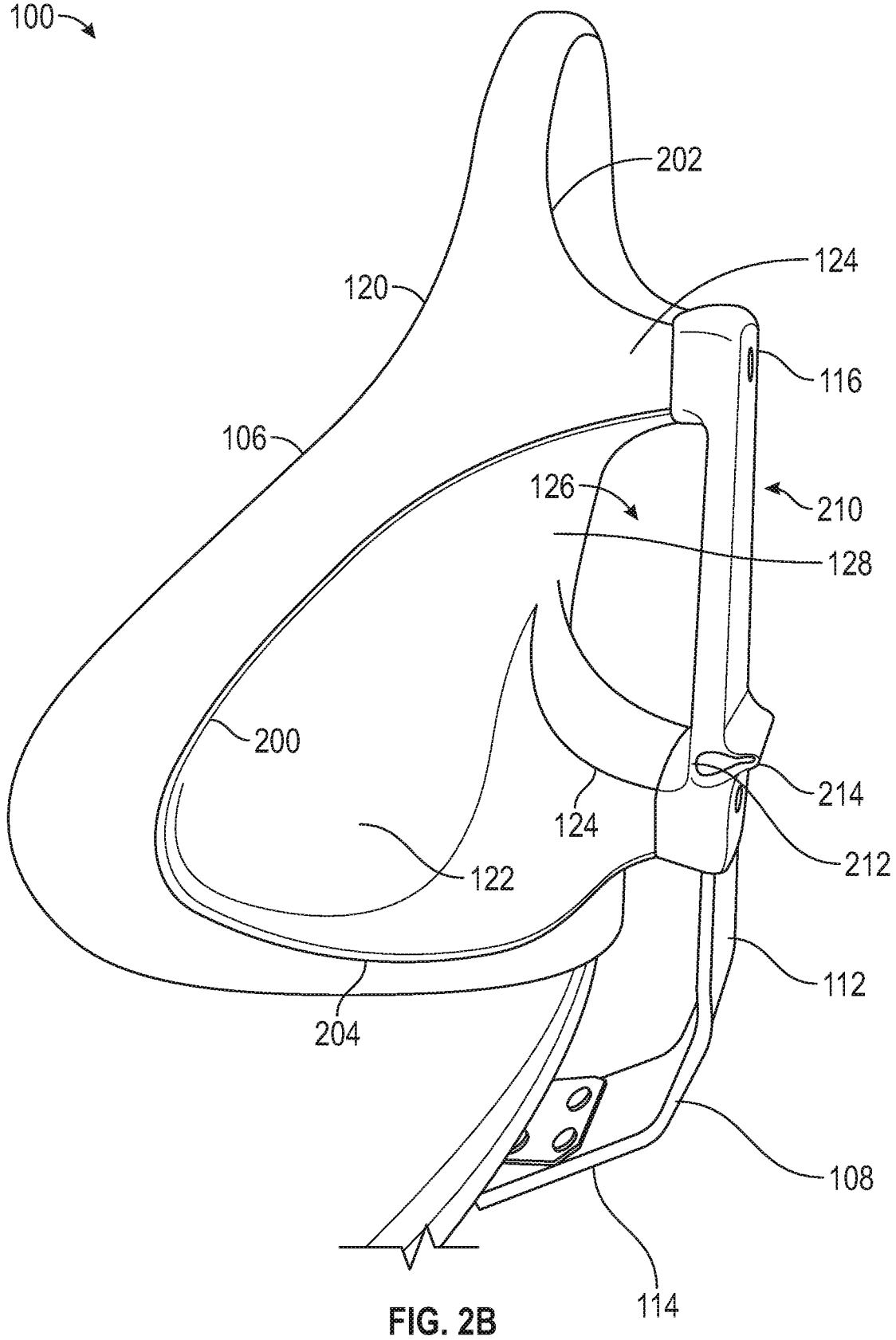
FIG. 2B is a detailed perspective view of the pliable backrest of FIG. 2A.

In another example, the seating assembly 100 includes one or more additional features to provide enhanced comfort, conformation to the back and flexibility to the occupant of the seating assembly 100. Referring to FIG. 2B, in one example, such a feature is provided with a joint assembly 210. The joint assembly 210 is, in one example, provided as a component of the upright 108. For instance, the second upright end portion 116 includes the joint assembly 210 and the second upright end portion 116 is coupled with the first upright end portion 114, for instance, extending to the seat 102. Optionally, the joint assembly 210 is interposed between the first and second upright end portions 114, 116.

As shown in FIG. 2B, the joint assembly 210 includes a pivot 212 and, in one example, a stop 214. As described herein, the pivot 212 facilitates the reclining of the pliable backrest 106 with rotational movement at the pivot 212. The pliable material of the backrest 106 deforms with reclining and the second upright end portion 116 rotates relative to the remainder of the upright 108 at the pivot 212. The pivot 212 facilitates deflection of the joint assembly 210 and movement of the second upright end portion 116 to follow the change orientation of the pliable backrest 106. The rotational freedom of the joint assembly 210 further enhances the flexibility and conformation of the pliable backrest 106 relative to the occupant. For instance, with reclining movement, the pliable backrest 106 deforms (compresses or fills) one or more of the spaces around the pliable pillars 124 including, for instance, the deformation gap 126 underlying the support span 128. With reclining movement the second upright end portion 116 rotates to reduce bracing of the pliable backrest 106 that may otherwise constrain deformation. Instead, the second upright end portion 116 rotates (clockwise from the orientation shown in FIG. 2B) to follow and facilitate the reclining deformation of the pliable backrest 106. Accordingly, the pliable backrest 106 deforms, arcs, curves or the like to accordingly follow the deflection of the occupant's back as the occupant reclines. The pivot 212 of the joint assembly 210 permits movement of the second upright end portion 116 to follow this movement and deformation.

In another example, the joint assembly 210 includes a stop 214 shown in FIG. 2B. As will be described herein, the stop 214 includes one or more engaging surfaces or features configured to support the pivot 212 during rotation, for instance, beyond an initial deflection arc of the joint 212. The surfaces of the stop 214 support the joint assembly 210 and accordingly provide a counterforce, counter torque or the like to the second upright end portion 116 and the pliable backrest 106 during reclining movement. The stop 214, in combination with the pivot 212, provides additional support to the pliable backrest 106 (and the occupant) as the occupant reclines in the seat assembly 100. Additionally, and as described herein, the surfaces of the stop 214 are configured to engage at a specified rotational position the of second upright end portion 116, and accordingly provide the counterforce, counter torque or the like at that position and beyond. In another example, the surfaces of the stop 214 include different shapes, tapers, contours or the like (collectively profiles) to facilitate graduated support that increases gradually, in a staggered manner or the like with increasing rotation of the second upright end portion 116.

Figure 3:
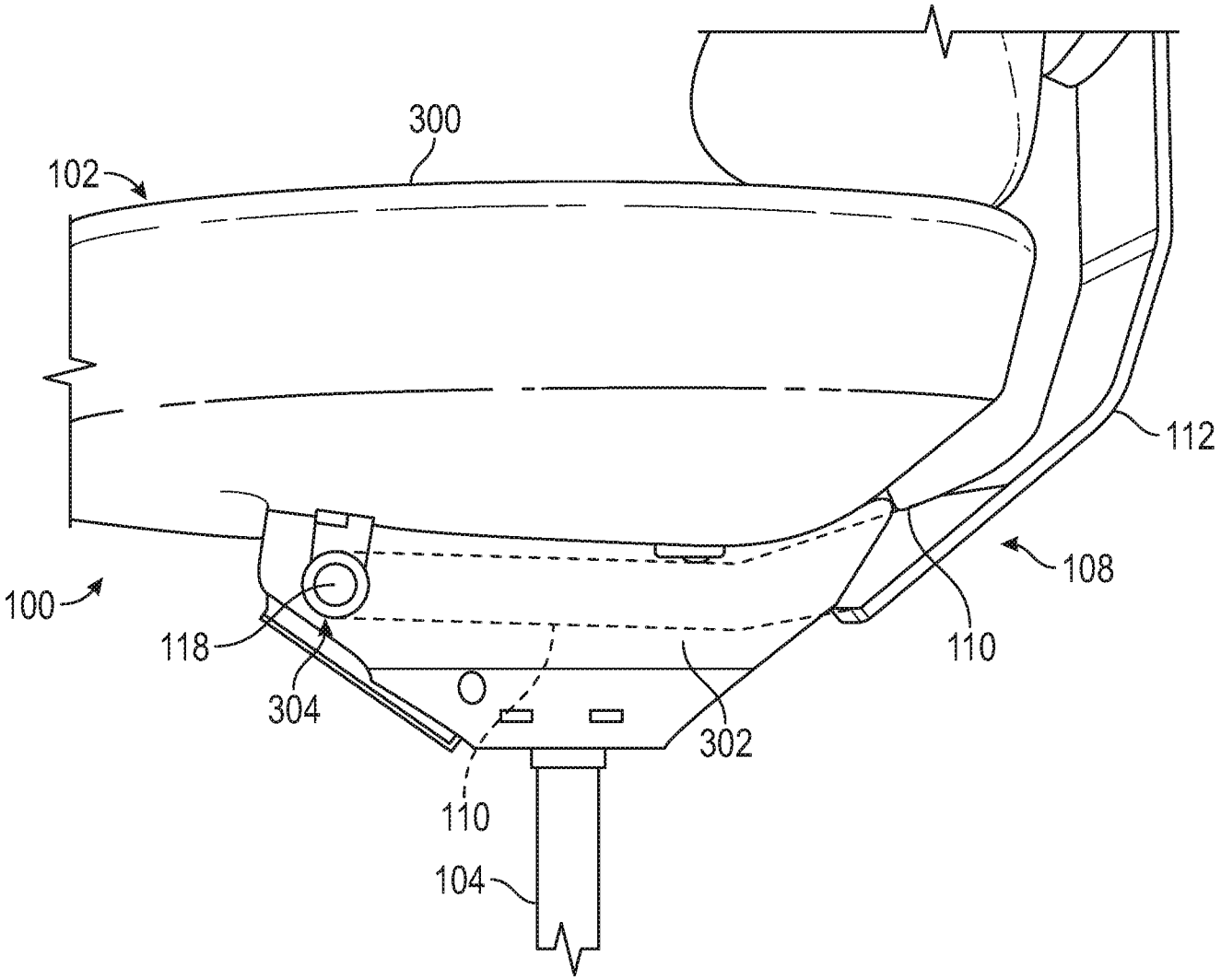
FIG. 3 is a bottom perspective view of one example of an upright coupled with a seat.

FIG. 3 shows a side view of the seat 102 of the seat assembly 100 previously shown in FIG. 1. The upright member 112 is rotatably coupled with the seat 102. The base housing 302 is shown with a pivot socket 304 coupled with a pivot hub 118. The pivot hub 118 is, in one example, proximate an end portion of the upright bracket 110, The upright bracket 110 extends through the base housing 302 and is coupled with the upright member 112. The upright member 112 is, in turn, coupled with the pliable backrest 106 shown in FIGS. 2A, B. The pivot socket 304, in combination with the pivot hub 118, facilitate the pivoting movement of the upright bracket 110 and the upright member 112 to accordingly recline the upright member 112 and the pliable backrest 106. As shown, the seat pan 300 of the seat 102 is coupled with an underlying frame member, for instance, a base housing 302. As will be described herein, the coupling of the seat pan 300 to the base housing 302, in one example, preloads one or more features such as biasing elements coupled with an upright bracket 110 of an upright 108. The preloading of the biasing elements is accomplished during assembly (e.g., fastening of the seat pan to the base housing) and without labor and time intensive loading of springs, torsion bars or the like. Coupling of the base housing 302 with the seat pan 300, for instance, by way of the tightening or fastening of one or more fasteners between the seat pan 300 and the base housing 302 preloads the biasing elements and accordingly provides a specified preload (torque, force or the like) to the upright member 112 to maintain the upright member 112 and the pliable backrest 106 in an initial neutral position, for instance, in a substantially vertical position prior to engagement with the back of the occupant. Additionally, the preloading of the upright bracket 110 with the biasing elements, in one example, provides the specified preload through the upright member 112 and the pliable backrest 106 to the occupant, for instance, during reclining to support reclining and to assist in returning the pliable back rest and the upright member to the initial neutral position.

Figure 4B:
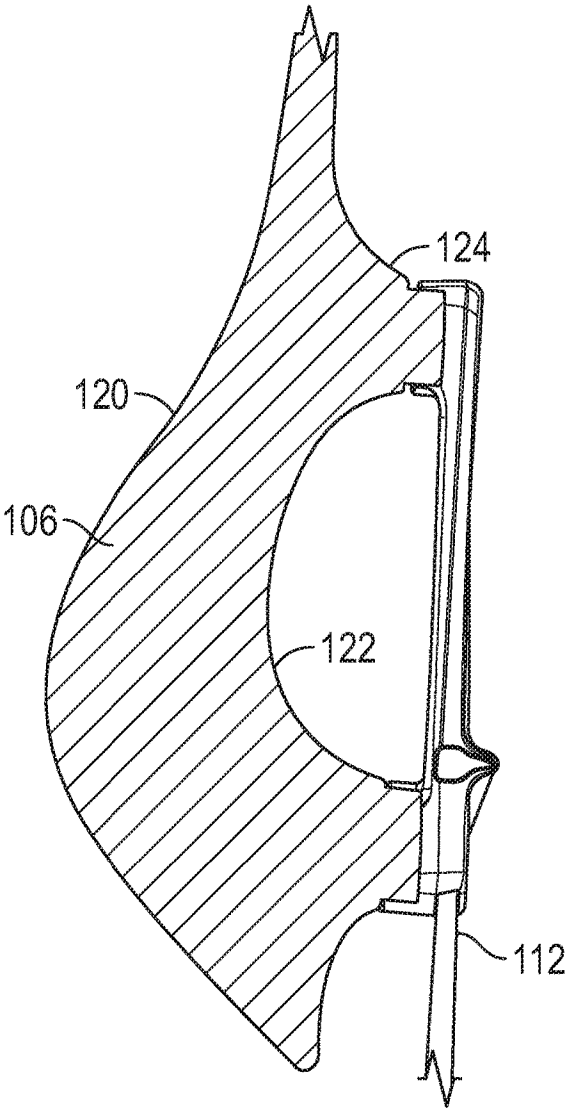
FIG. 4B is a cross sectional view of the pliable backrest of FIG. 4A.
Figure 4A:
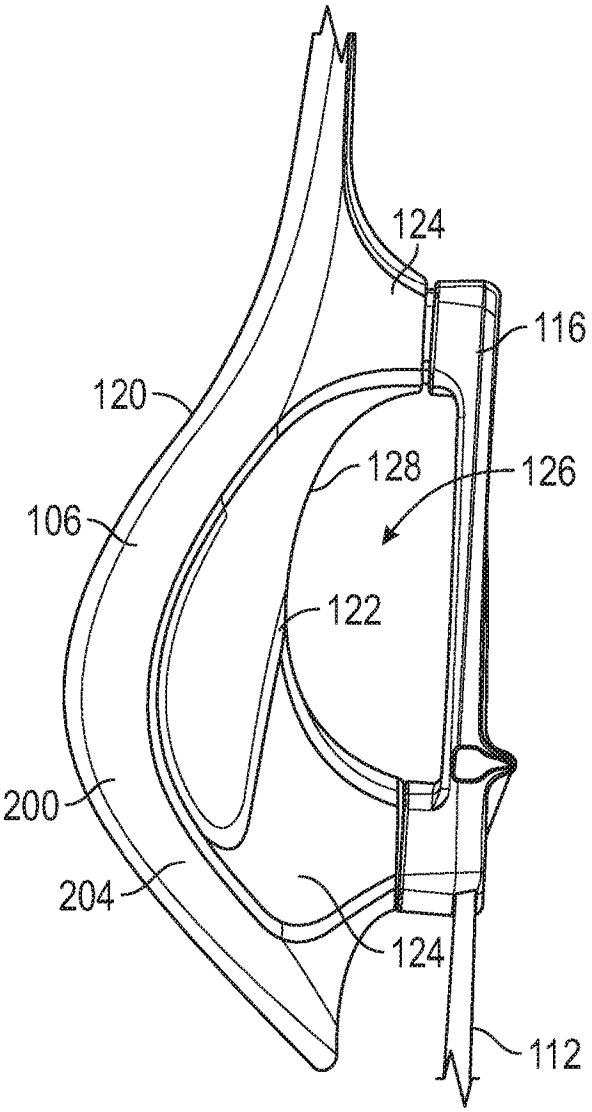
FIG. 4A is a side view of one example of the pliable backrest.

FIG. 4A shows one example of the pliable backrest 106 previously shown in FIG. 1. In this example, the upright member 112 is without the joint assembly previously described and shown, for instance, in FIG. 2B. Referring again to FIG. 4A, the pliable backrest 106 includes the support face 120 and the coupling face 122. As previously described, the pliable material of the pliable backrest 106 extends from the support face 120 to the coupling face 122. As shown in FIG. 4B (a cross-sectional view), the pliable material of the pliable backrest 106 optionally extends continuously from the support face 120 to the coupling face 122, for instance, along and through one or more pliable pillars 124, With the pliable backrest 106, the support face 120 is, in one example, deformable into a number of configurations to accordingly follow and conform to the contours of the back in different postures, with different movements or the like. Accordingly, occupants having different proportions, shapes, corresponding variations in movement (reclining, titling, twisting) or the like are able to comfortably assume comfortable seated postures and move between various positions while maintain support with the pliable backrest 106.

As further shown in FIG. 4A, the pliable backrest 106 includes one or more lateral wings 200, for instance, extending away from a medial portion of the pliable backrest 106. The lateral wings 200, in one example, are surrounded (continuously or discontinuously) by the pliable frame 204 extending around the pliable backrest 106. As previously described, the pliable frame 204, in one example, is a bead of pliable material, for instance the same pliable material of the pliable backrest 106, that provides additional support to the components of the pliable backrest 106 such as the perimeter wings 200, 202. In another example, the pliable frame 204 is a different pliable material, for instance, a different elastomer, elastomeric foam, polymer, rubber or the like coupled along the pliable backrest 106 and configured to provide additional support to one or more features of the pliable backrest 106. In a similar manner to the remainder of the pliable backrest 106, the pliable frame 204 is deformable and follows the contours, movements or the like of an occupant in the seat assembly 100 while providing enhanced support to components of the pliable backrest 106.

As further shown in FIG. 4A (and also shown in FIG. 4B), the coupling face 122 is coupled with the upright member 112. In this example, the pliable backrest 106 includes two pliable pillars 124 extending from the remainder of the pliable backrest 106 to the upright member 112. As previously described, the pliable pillars 124 are, in various examples, constructed with the pliable material of the remainder of the pliable backrest 106. Accordingly, the pliable pillars 124 are configured to deform, compress, expand or the like to accordingly facilitate the deformation, deflection or the like of the pliable backrest 106 to accordingly conform to the contours and movements of an occupant of the seat assembly 100.

As further shown in FIG. 4A, a support span 128 optionally extends between each of the pliable pillars 124. The support span 128, in combination with the pliable pillars 124, extends around a deformation gap 126 providing spacing between the pliable backrest 106 and the upright member 112. As described herein, in one example, deformation of the pliable backrest 106 compresses the pliable material of the backrest at least partially into the deformation gap 126 to facilitate deformation of the backrest and conformation to the contours and movements of the occupant.

As previously described, FIG. 4B shows a cross-sectional view of the pliable backrest 106 shown in FIG. 4A. In tins example, the pliable material of the pliable backrest 106 extends continuously between the support face 120 and the coupling face 122. The pliable material of the pliable backrest 106 extending between the support and coupling faces 120, 122 facilitates the support of the back of the occupant both while sitting in the seating assembly 100 as well as moving in the seating assembly while at the same time facilitating deformation of the pliable backrest 106 to accordingly follow the contour of the back, for instance, during twisting movement, reclining, tilting or the like.

Figure 5A:
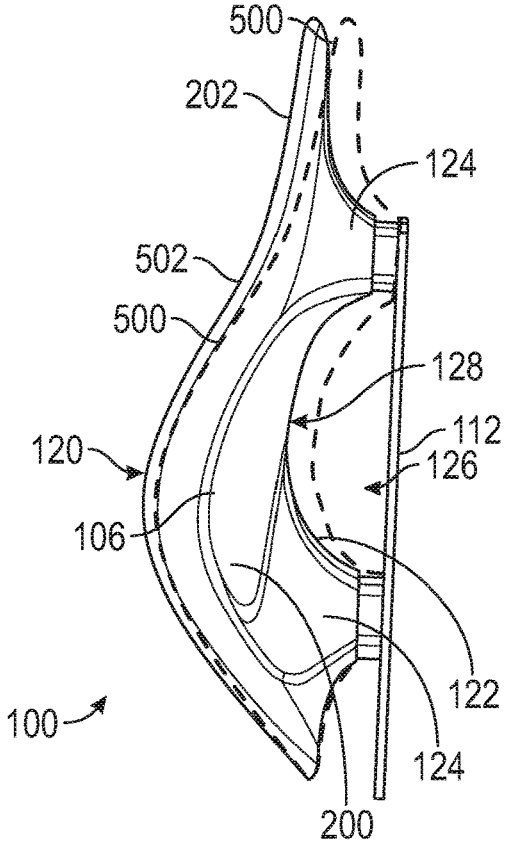
FIG. 5A is a side view of a seat assembly having a pliable backrest in a first example reclined configuration.

FIG. 5A shows one example of the pliable backrest 106 in a first deformation configuration 500. In this example, the first deformation configuration is shown in broken lines relative to a neutral position shown in solid lines. As shown in FIG. 5A, in the first deformation configuration 500 the pliable backrest 106 is deformed in a manner corresponding to a reclining movement by the occupant. The support face 120 deforms from a back contour plane 520 shown in FIG. 5A (e.g., a neutral or initial configuration) with the reclining movement of the occupant and accordingly assumes the first deformation configuration 500 shown in FIG. 5A.

For instance, as shown in FIG. 5A, the support face 120 assumes a deflected configuration shown by the broken lines while the coupling face 122 also deforms. With reclining movement the support span 128 deforms and fills at least a portion of the deformation gap 126 according to the degree of reclination assumed by the occupant. As further shown in FIG. 5A, the pliable pillars 124 widen or expand outwardly to fill a portion of the deformation gap 126 as well as one or more of the zones on either side of the pliable pillars 124. In a similar manner, the vertical wing 202 of the pliable backrest 106 also deforms, for instance, to follow the reclining position of the occupant's upper back, neck and head into the position shown with the first deformation configuration 500. Accordingly, as shown in FIG. 5A, deformation of the pliable backrest is transmitted through the backrest 106 from the support face 120 to the coupling face 122 to facilitate conformation of the pliable backrest 106 to the contour of the user (back, neck, head or the like) while at the same time providing support to the occupant during movement into the reclined position. Further, the support face 120 and the pliable material of the pliable backrest 106 follow the contours of the back from the back contour plane 502 (e.g., an initial configuration) in solid lines in FIG. 5A and to the first deformation configuration 500. Accordingly, the pliable backrest 106 provides continuous support while at the same time following the contour of the occupant back into the first deformation configuration 500.

Figure 5B:
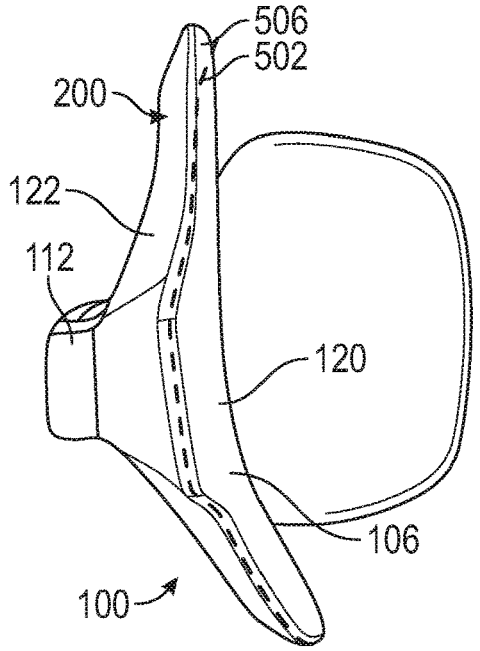
FIG. 5B is a top view of the seat assembly of FIG. 5A in a second example reclined configuration including a twist.

FIG. 5B shows a top-down view of the pliable backrest 106 previously described and shown in FIG. 5A. In this example, a second deformation configuration 506 is shown in solid lines while the back contour plane 502 (initial configuration) of the pliable backrest 106 is shown in dashed lines. In this example one of the lateral wings 200 (the left in FIG. 5B) is deflected relative to the back contour plane 502 the pliable backrest. The pliable backrest 106 and the support face 120 deform in a corresponding manner to twisting or rotating movement by the occupant. The pliable backrest 106, proximate to the lateral wing 200, follows and conforms to the contour and movement of the back of the occupant. Because the pliable backrest 106 is constructed with a pliable material and is not otherwise constrained, for instance, with a frame, backplate or the like, the lateral wings 200 support the occupant in the second deformation configuration 506 to support the occupant during movement and at the same time deform under the applied load and conform to the changing contour of the back of the occupant.

Figure 5C:
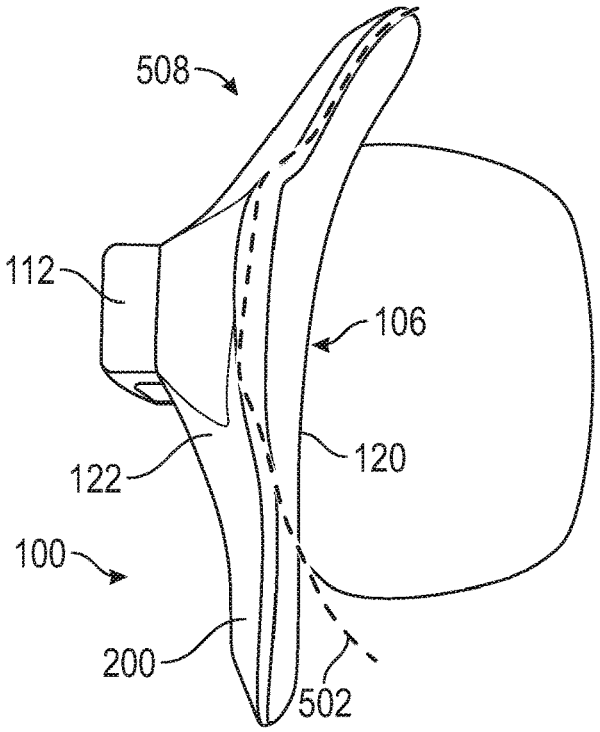
FIG. 5C is a top view of the seat assembly of FIG. 5A in a third example reclined configuration including another twist.

FIG. 5C shows an opposed third deformation configuration 508, In the top-down view provided in FIG. 5C, the opposed lateral wing 200 relative to FIG. 5B is deflected.

The back contour plane 502 corresponding to the support face 120 in an undeflected or neutral configuration is shown in dashed lines. The occupant, in one example, seated in the seating assembly 100, twists to the right (e.g., to access one or more components, controls or the like at a table, desk or workstation). Twisting movement of the upper and lower back of the occupant correspondingly deforms the lateral wing 200 and bends the lateral wing 200 into the third deformation configuration 508. The pliable backrest 106 deforms to follow the contour of the back during the movement while at the same time providing support.

In each of the examples shown in FIGS. 5B and 5C the pliable backrest 106 optionally includes the pliable frame 204 to further support the lateral wings 200 and provide additional support to the occupant during the twisting or rotational movement. The lateral wings 200 having the pliable frame 204 include a pliable bead of the pliable material used for the pliable backrest 106 that bolsters or enhances the support provided by the lateral wings 200 and accordingly supports the occupant during the twisting or rotational movement while permitting deformation of the lateral wings 200 into the second and third deformation configurations 506, 508 shown.

Figure 5D:
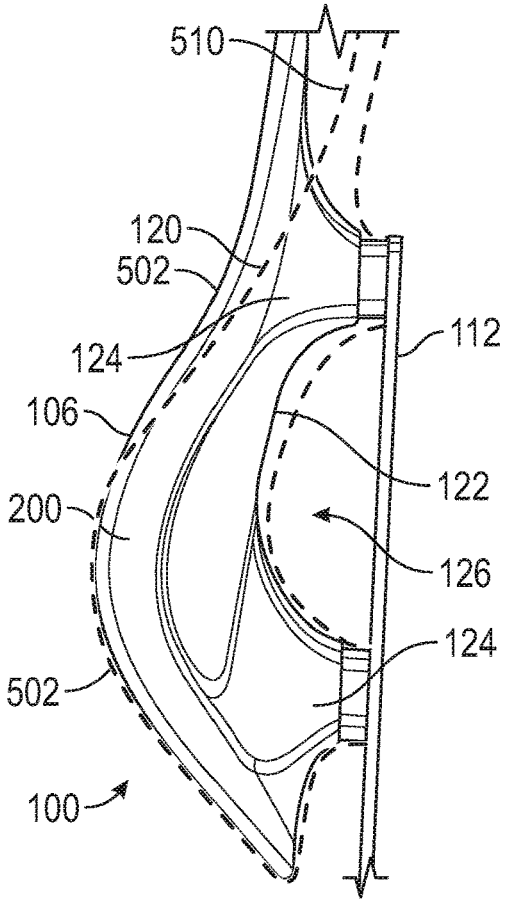
FIG. 5D is a side view of the seat assembly of FIG. 5A in a fourth example reclined configuration including tilt.

FIG. 5D shows another example of the pliable backrest 106 in a fourth deformation configuration 510. In this example, the occupant applies pressure along an upper portion of the pliable backrest. For instance, an occupant arches the back while the lower (lumbar) region of the back remains relatively static. In contrast, in FIG. 5A, the user reclines a larger portion of the back, for instance, from the lumbar through the upper back. As shown in FIG. 5D, the pliable backrest 106 including the support face 120 deforms relative to the back contour plane 502 (solid lines) and conforms to the differing contour of the occupant back (relative to the first deformation configuration 500). The pliable backrest 106 along the support face 120 assumes a configuration substantially matching that of the neutral undeflected configuration of the back contour plane 502 proximate the lower portion of the pliable backrest while the upper portion of the pliable backrest 106 deflects into the position shown with the dashed lines. Similarly, the deformation gap 126 is only partially filled relative to the first deformation configuration 500 shown in FIG. 5A. In this example, filling of the deformation gap 126 is provided by a corresponding upper portion of the pliable backrest 106 and the pliable pillar 124 provided at the upper end of the upright member 112. Accordingly, the pliable backrest 106 fills the corresponding upper portion of the deformation gap 126 while the remainder of the pliable backrest 106 continues to support the lumbar portion in its original upright position.

In each of FIGS. 5A and 5D, including the first and fourth deformation configurations 500, 510, the pliable backrest 106 provides support to the occupant in a variety of anatomical positions while at the same time conforming to the back of the occupant during movement, changes in posture or the like. Stated another way, the back of the occupant is supported in a variety of back positions, movements, configurations or the like. At the same time, the pliable backrest 106 is configured to conform and thereby follow the contour of the occupant, for instance, along the back contour plane 502, to allow movement of the occupant into a number of positions including one or more of twisting positions, reclining positions, tilting positions, arching positions or the like. The pliable backrest 106 flexibly assumes each of these configurations without constraint otherwise provided with back plates, frames or the like provided within or along a back surface of the backrest.

Figure 5E:
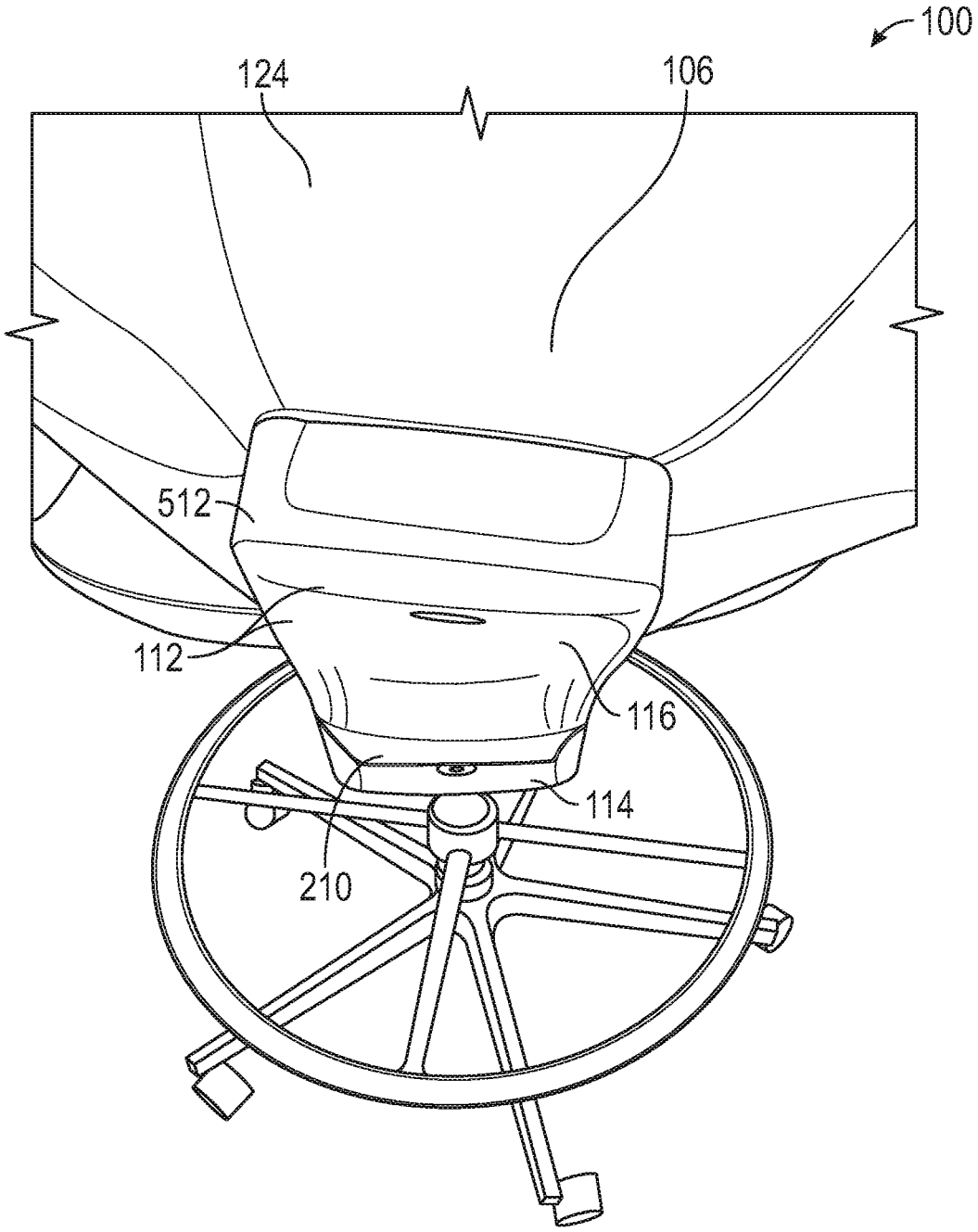
FIG. 5E is a top view of the seat assembly of FIG. 5A in a fifth example reclined configuration including twisting of an upright.

FIG. 5E shows a detailed back view of the upright member 112 and the pliable backrest 106. As shown, the upright member 112 is provided in a twisted configuration 512 during twisting movement by the occupant of the seating assembly 100. As shown in the example provided in FIG. 5E, the upright member 112 optionally includes the joint assembly 210. In another example, the upright member 112, shown in FIG. 5E, is without the joint assembly 210.

The upright member 112, in this example, is in the twisted configuration 512. For instance, the first or lower upright portion 114 of the upright member 112 is in the configuration shown in FIG. 1. The second or upper upright portion 116 of the upright member 112 is twisted relative to the first upright portion 114. For example, the second upright portion 116 is constructed with a material having greater pliability than the first upright portion 114 of the upright member. In another example, the upright member 112 is constructed with one or more materials facilitating the deflection of the upright member 112 into the twisted configuration 512. For instance, the upright member 112 is constructed with a pliable material that facilitates twisting deformation into configuration 512 while at the same time providing support to the pliable backrest 106 and the occupant. In the example shown in FIG. 5E, the second upright portion 116 includes, but is not limited to, a deformable polymer, a thermoplastic elastomer polymer, or other elastomeric materials with relatively high elastic strain limits (e.g., to permit deflection without permanent deformation, failure or the like). One example of a material for the second upright portion 116 includes Hytrel®, a registered trademark of E.I DuPont De Nemours & Co.

In use, an occupant, desiring to twist in either the left or right directions, twists in the seating assembly 100 and engages the pliable backrest 106. The pliable backrest 106 conforms to the twisting movement and correspondingly deforms into configurations 506, 508 as shown in FIGS. 5B, C. The pliable backrest 106 deforms, as previously described and shown, for instance, in FIGS. 5A-D to facilitate the movement of the occupant while at the same time supporting the upper and lower back portions of the occupant. In the example shown in FIG. 5E, the upright member 112 is pliable and also twists into the configuration 512 shown to enhance the flexibility of movement provided by the pliable backrest 106 while at the same time providing support to the pliable backrest 106 and the occupant.

Figure 6:
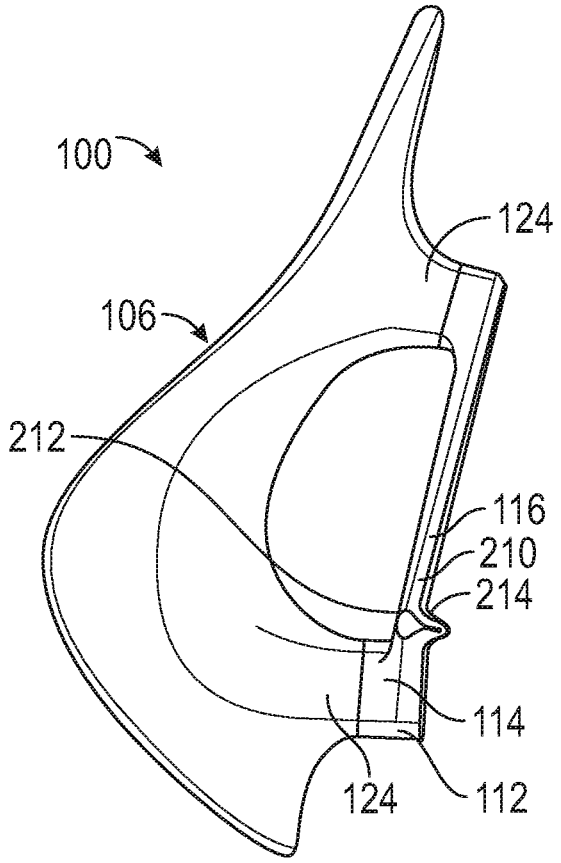
FIG. 6 is a side view of another example of a seat assembly including a joint assembly.

FIG. 6 shows another view of a seating assembly 100 including a portion such as a pliable backrest 106 coupled with the upright member 112, In this example, the upright member 112 includes the joint assembly 210 previously-described and shown in FIG. 2B. As further shown in FIG. 6, the pliable backrest 106 is in a deformed configuration relative to the neutral configuration shown, for instance, in FIGS. 1 and 2B. As previously described, the pliable backrest 106 is constructed with a pliable material that deforms with reclining, tilting, twisting movements or the like. As shown in FIG. 6, the pliable backrest 106 is deformed in a manner consistent with reclining of the seat assembly 100. For instance, the pliable backrest 106 is deformed into an arcuate configuration and the joint assembly 210 and the second upright portion 116 follow this deformation.

As further shown in FIG. 6, the joint assembly 210 includes a stop 214 including one or more stop interfaces as described herein. The stop interfaces of the stop 214 engage after rotation of the upright member 112 through a first arc, for instance, corresponding to movement of the pliable backrest 106 between a neutral configuration, for instance, that shown in FIG. 1, and a first reclined position such as that shown in FIG. 6. With further rotation the stop interfaces engage and impart a counterforce or counter torque to the upright portion 116 and the pliable backrest 106, and optionally arrest further reclining of the pliable backrest 106.

Figure 7A:
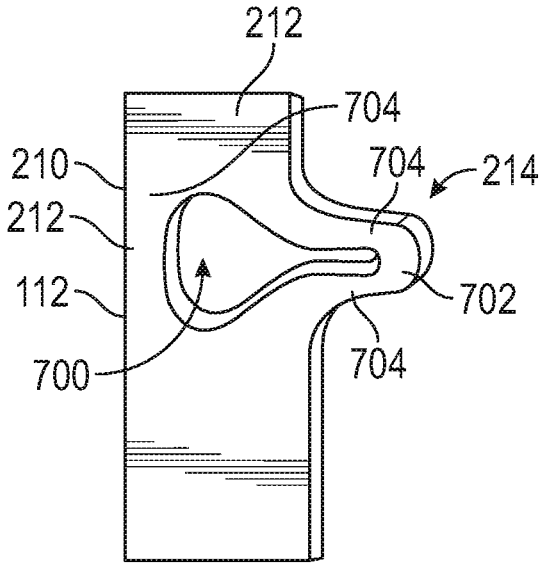
FIG. 7A is a detailed side view of one example of a joint assembly in a neutral configuration.
Figure 7B:
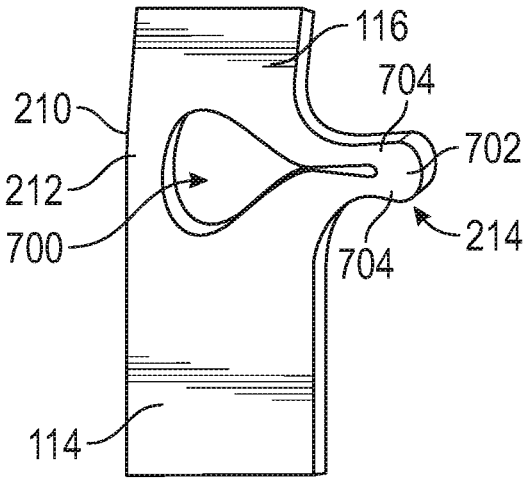
FIG. 7B is a detailed side view of the joint assembly of FIG. 7A in an example reclined configuration.

FIGS. 7A and 7B show detailed views of one example of the joint assembly 210 and first and second pivot configurations respectively. In the example shown in FIG. 7A, the joint assembly 210 is provided in an initial or neutral configuration (an angle of 0 degrees or passive deformation based on the weight of the backrest 106). The joint assembly 210 includes the pivot 212 and the stop 214. In this example, the stop 214 includes a nose 702 interconnecting each of the stop interfaces 704. As further shown, a stop gap 700 is provided with the joint assembly 210 to facilitate rotation at the pivot 212 to facilitate pivoting of the upright member 112 into the second pivot configuration shown in FIG. 7B.

In the view shown in FIG. 7A, each of the stop interfaces 704 are provided on opposed sides of the stop gap 700. In one example, the stop interfaces are components of the upright member 212. For instance, the stop interfaces 704 are molded components of the upright member 212, standalone components fixed to portions of the upright member 212 or the like. As further shown in FIG. 7A, each of the stop interfaces 704 are disengaged (excepting the nose 702). In this configuration, the stop interfaces 704 provide minimal support (e.g., counter moment, counterforce or the like) relative to pivoting movement of the joint assembly 210. Instead, the stop interfaces 704 are passive in the first pivot configuration and accordingly pivoting at the pivot 212 of the joint assembly 210 is readily conducted prior to engagement of the stop interfaces 704. The stop interfaces 704 transition across the stop gap 700 with movement of the upright 212 such as reclining rotation until engagement, for instance, as shown in FIG. 7B.

Referring now to FIG. 7B, the upright member 112 including the joint assembly 210 is shown in a second pivot configuration. The pivot 212 is rotated and the second upright portion 116 is angled relative to the first upright portion 114 of the upright member 112. As shown in FIG. 7B, the stop interfaces 704, previously disengaged in FIG. 7A, are in an engaged configuration. Additionally, the nose 702 includes a teardrop or deflected configuration relative to the configuration of the nose 702 in FIG. 7A. With the stop interfaces 704 engaged, one or more of a support force, counterforce, counter torque or counter moment is applied to the joint assembly 210, the upright member 112 and the pliable backrest 106. Accordingly, with continued reclining of the pliable backrest 106, for instance, beyond the initial engagement of the interfaces 704 in FIG. 7B, the stop interfaces 704 apply additional support to the upright member 112 and the pliable backrest 106. The additional support moderates further rotation of the upright member 112 and the pliable backrest, and additionally assists in returning the upright member 112 and the pliable backrest 106 to the initial neutral configuration as the occupant sits up.

Optionally, the stop interfaces 704 are shaped, for instance, by one or more of molding, cutting, machining, pre-deformation or the like to alter or tune the support provided by the joint assembly 210 to the pliable backrest 106 and the upright member 112. For instance, one or more of tapers, corners or the like are applied to the stop interfaces 704, for instance, by profiling of the nose 702 (e.g., including crimping, clipping, compressing, constraining, expanding or the like). Profiling of the interfaces facilitates the control and tuning of support provided by the support interfaces 704 to the upright member 112 and the pliable backrest 106. For example, the rotational position of the upright member 112 that initiates application of support by the interfaces 704 is controlled with profiling. Profiling that tapers or compresses the stop interfaces 704 into closer proximity across the stop gap 700 initiates support at an earlier rotational position. Conversely, expanding the stop interfaces 704 from each other (increasing the stop gap 700) initiates support at a greater rotational position.

Additionally, in other examples, the shaping of the stop interfaces 704 provides a gradual interface between the stop interfaces 704, for instance, by way of a tapered interface configured to gradually increase the surface-to-surface engagement between the stop interfaces 704 and accordingly provide increased support (e.g., counter torque, counterforce or the like) with continued reclining of the pliable backrest 106 and the upright member 112. Stated another way, the stop interfaces 704 of the stop 214, in one example, provide graduated support that increases with greater reclination of the pliable backrest 106. Accordingly, as an occupant continues to recline in the seating assembly 100, the stop interfaces 704 provide gradually greater counterforces, counter moments or the like.

Figure 8:
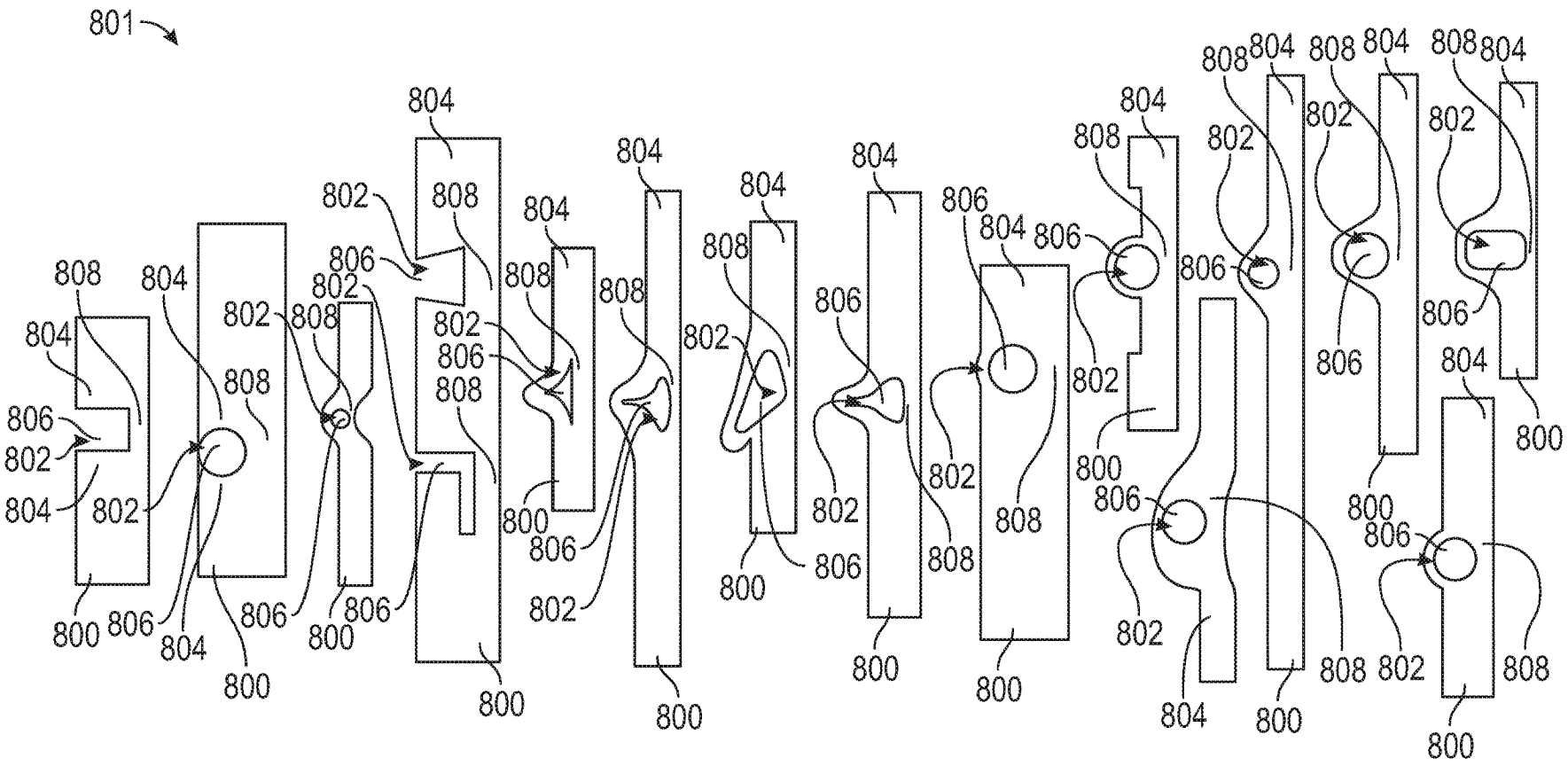
FIG. 8 is a side view of multiple example joint assemblies with different pivots and stop interfaces.

FIG. 8 shows various joint assemblies 801 providing a variety of stops 802 and corresponding pivots 808. In the example shown in FIG. 8, each of the stops 802 include varied stop interfaces 804 configured to corresponding varied support characteristics to the upright members 800. In some examples, the stops 802 include a squared, circular, ovular or multi-shaped profile providing corresponding support characteristics to the upright member 800 and a pliable backrest, such as the backrest 106 coupled to the upright member 800. In another example, the upright member 800 is a component of an overall upright member, for instance, a joint assembly 801 included as a separate component of one or more upright members, such as the upright member 112 shown previously herein.

As shown in FIG. 8, the various stop interfaces 804 on either side of the stops 802 have differing profiles to accordingly provide differing support characteristics to the corresponding upright members 800. Additionally, the stop gaps 806 have complementary profiles to the stop interfaces 804 and contribute to the control of support, characteristics by the stops 802, For instance, with a larger stop gap 806, as shown in the left most embodiment of FIG. 8, the stop interfaces 804 are configured to engage at a later portion of rotational movement at the pivot 808. Accordingly, support from the stop 802 having the stop interfaces 804 is triggered or initiated at a later portion of rotation or reclination of the pliable backrest 106. Conversely, at least some of the stops 802 including, for instance, tapered stop interfaces 804 tapering toward each other, tapering downwardly and optionally having interconnected noses between the stop interfaces 804 facilitate the gradual application of support (e.g., counterforce, counter moment or the like) by the stop interfaces 804 as the stop interfaces 804 engage in gradual and increasing surface-to-surface contact with increased reclining of the pliable backrest 106 and the upright member 800.

As shown in FIG. 8, by controlling the profile of one or more of the stop interfaces 804 and the stop gaps 806, the support properties of the various stops 802 are accordingly tuned according to the needs and specifications for a seat assembly, such as the seat assembly 100 shown in FIG. 1. In various examples, the profiles of the stop gaps 806 and stop interfaces 804 are controlled through one or more of molding, crimping, compression, machining or the like of the joint assemblies 801 to provide the desired profile and support characteristics for the seat assembly.

Figure 9:
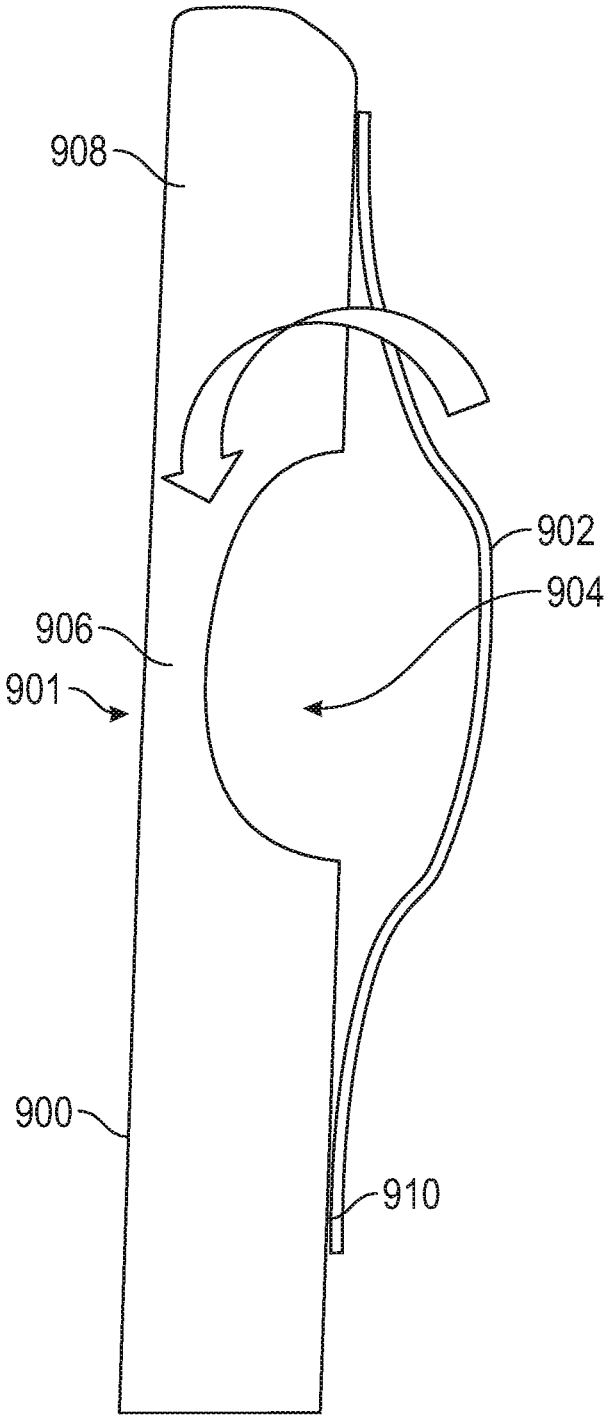
FIG. 9 is a side view of another example joint assembly.

Referring now to FIG. 9, another example of an upright member 900 is shown. In this example, the pivot 906 of the joint assembly 901 is in a reversed configuration relative to previously shown pivots herein. For instance, in this example, the pivot 906 is on an opposed portion of the joint assembly 901 of the upright member 900 relative to the pliable backrest 106 shown in FIG. 1. For example, the pliable backrest 106 is coupled, for instance, with one or more pliable pillars 124 on the rightmost surface of the upright member 900 while the pivot 906 is on the opposed left surface. Rotation of the upright member 900 (e.g., the second upright portion 908 relative to the first upright portion 910) is accomplished with counterclockwise reclining of the pliable backrest 106. The pivot 906 deflects to accordingly rotate the second upright portion 908 relative to the first upright portion 910.

As further shown in FIG. 9, the joint assembly 901 includes a stop 902 provided along the right surface of the upright member 900, the surface configured for coupling with the pliable backrest 106. The stop 902, as shown in FIG. 9, is, in one example, a belt, strap, strut or the like coupled between the second and first upright portions 908, 910. The stop 902 in a neutral configuration like that shown in FIG. 9 has a length dimension greater than the span of the stop gap 904 to accordingly facilitate rotation of the pivot 906 in the direction shown. As the second upright portion 908 rotates relative to the first upright portion 910, the stop 902 (another example of a nose) is tensioned between the second and first upright portions 908, 910. The tensioning of the stop 902 accordingly provides support in a similar manner relative to the stop interfaces previously described herein. In this example, as the stop 902 approaches a taut configuration, increased support is experienced in the upright member 900 thereby providing a counterforce or counter moment to continued counterclockwise reclining of the upright member 900.

In one example, with the stop 902 in a taut configuration (e.g., with little or no additional length to span the stop gap 904) further rotation of the second upright portion 908 relative to the first upright portion 910 is arrested. In another example, the stop 902 is constructed with a pliable material (e.g., an elastomer, spring or the like) that provides a graduated tension across the stop gap 904 to each of the second and first upright portions 908, 910 according to the reclining of the pliable backrest 106 and the upright member 900. In this example, the counterforce or counter moment applied by the stop 902 gradually increases with increased reclining of the pliable backrest 106 and the upright member 900.

Figure 10:
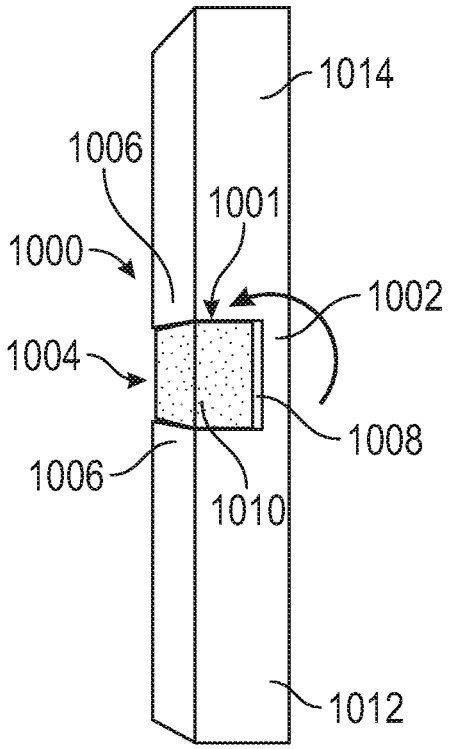
FIG. 10 is a perspective view of a joint assembly including one example of a bias insert.

FIG. 10 shows another example of an upright 1000 including a joint assembly 1001 having a pivot 1002 and stop 1004. In this example, the joint assembly 1001 includes stop interfaces 1006 on either side of a stop gap 1008. The pivot 1002 is interposed between the first and second upright portions 1012, 1014 to facilitate rotation of the second upright portion 1014 relative to the first upright portion 1012, for instance, during reclining or other movement of the pliable backrest 106.

As further shown in FIG. 10, a bias insert 1010 is optionally included between the stop interfaces 1006. The bias insert 1010 is, in one example, a component of the stop 1004 along with the stop interfaces 1006. The bias insert 1010 is installed within the stop gap 1008 and provides a compressible fitting that enhances support during movement at the joint assembly 1001 (e.g., between the upright portions 1014, 1012). In one example, the bias insert 1010 works in combination with the stop interfaces 1006 to provide tiered support to the second upright portion 1014 during reclining of the pliable backrest 106. For instance, as the second upright portion 1014 is rotated counterclockwise, as shown in FIG. 10, the stop interfaces 1006 gradually close the stop gap 1008. Prior to engagement between the stop interfaces 1006, the bias insert 1010 (e.g., an elastomer, spring or the like) is compressed and provides an opposed restoring force or counter bias to each of the stop interfaces 1006 and corresponding the rotated second upright portion 1014. Accordingly, with increased reclining of the second upright portion 1014 the bias insert 1010 is further compressed and accordingly provides a greater restoring or biasing force (e.g., a counterforce, counter moment or the like) to the second upright portion 1014.

Additionally, as the stop interfaces 1006 close the stop gap 1008 and begin engagement, the bias insert 1010 optionally continues to provide a counterforce or counter moment to the second upright portion 1014. Accordingly, the stop interfaces 1006 and the bias insert 1010 operate cooperatively to support the second upright portion 1014 and thereby provide enhanced support to the pliable backrest 106 during reclining.

Figure 11A:
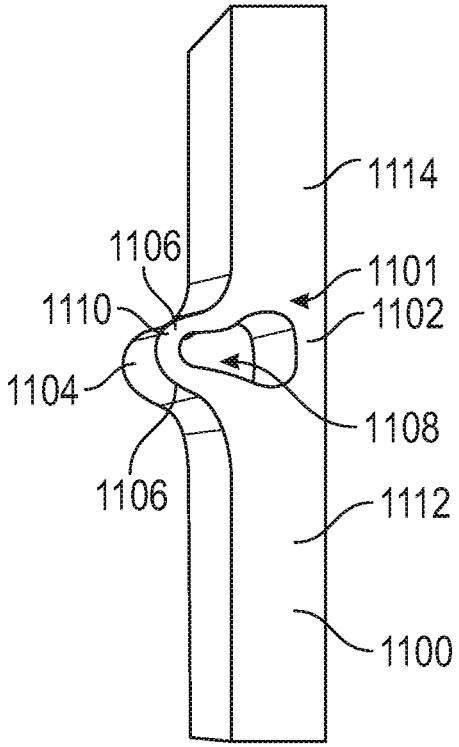
FIG. 11A is a side view of an example joint assembly.
Figure 11B:
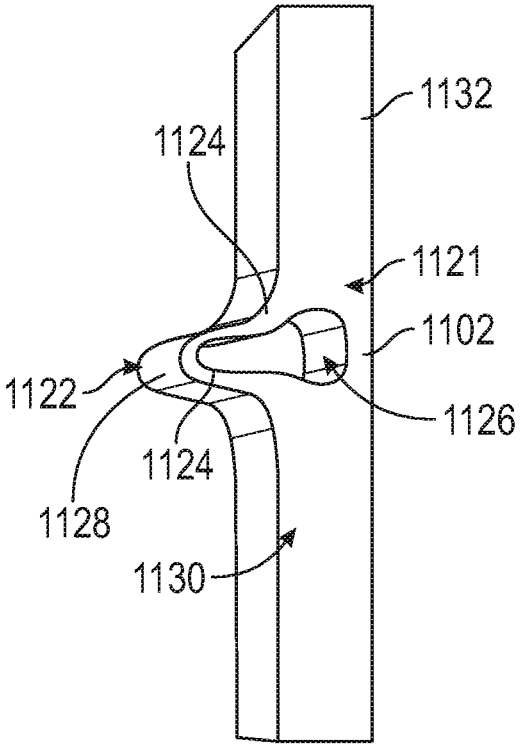
FIG. 11B is a side view of the joint assembly of FIG. 12A including compressed stop interfaces.

FIGS. 11A and 11B include example joint assemblies 1101, 1121, respectively, having variations in one or more components of the joint assemblies 1101, 1121 such as the noses 1110, 1128, Referring first to FIG. 11A, the upright 1100 is shown in a neutral configuration and includes a pivot 1102 and stop 1104. The stop 1104, in this example, includes opposed stop interfaces 1106 similar to the stop interfaces previously described herein. In this example, a nose 1110 bridges the stop interfaces 1106 and facilitates the guided engagement of the stop interfaces 1106. For instance, as the second upright portion 1114 is rotated relative to the first upright portion 1112 the nose 1110 guides the stop interfaces 1106 into a gradual engagement and accordingly graduates the application of a counterforce or counter moment to the second upright portion 1114 to gradually support the pliable backrest 106 with increasing counterforce or counter moment as the occupant reclines in the seat assembly. As shown in FIG. 11A, the stop gap 1108 follows the contour of the stop interfaces 1106 and the intervening nose 1110. In this example, the nose 1110 has a compressed configuration that provides a rounded transition between the stop interfaces 1006. Accordingly, the counterforce or counter moment provided by the stop interfaces 1106 is initiated at a relatively greater rotation of the second upright portion 1114 (in comparison to FIG. 11B). Stated another way, the stop gap 1108 is larger in FIG. 11A relative to FIG. 11B and accordingly the stop interfaces 1106 engage with greater rotation of the second upright portion 1114 relative to the first upright portion 1112.

Referring now to FIG. 11B, the joint assembly 1121 includes a series of components similar to the components of the joint assembly 1101 shown in FIG. 11A. For instance, the joint assembly 1121 includes a pivot 1102 and stop interfaces 1124. In this example, the stop interfaces 1124 are bridged by the nose 1128. As with the joint assembly 1101, shown in FIG. 11A, the joint assembly 1121 permits rotation of the second upright portion 1132 relative to the first upright portion 1130 at the pivot 1102.

As further shown in FIG. 11B, the nose 1128 has a compressed or crimped configuration relative to the nose 1110 shown in FIG. 11A. Accordingly with this configuration, the stop interfaces 1124 are more proximate to one another relative to the spaced arrangement shown in FIG. 11A. As shown in FIG. 11B, the stop gap 1126 proximate to the stop interfaces 1124, is smaller (has a lesser height) relative to the stop gap 1108 shown in FIG. 11A. Accordingly, the stop interfaces 1124 engage at smaller degree of rotation of the second upright portion 1132 relative to the first upright portion 1130. In the example shown then in FIG. 11B, the stop 1122, including the stop interfaces 1124, with closer proximate positioning provides a counter moment or counterforce to the second upright portion 1132 and the corresponding pliable backrest 106 at an earlier point in reclining of the seat assembly 100 with rotation of the second upright portion 1132.

In other examples, the stop gap 1108 as well as the corresponding surfaces of the stop interfaces 1124 are formed with other example profiles including, but not limited to, one or more of a tapered or contoured configuration to control the initiation of the engagement between the stop interfaces 1124, 1126. For instance, as previously described in FIG. 11B, the nose 1128 is optionally compressed to accordingly position the stop interfaces 1124 in proximity to one another. In another example, the stop gap 1126, including the surrounding components of the stop 1122, are formed, for instance, by one or more of molding, machining or the like to provide the stop interfaces 1124 in closer proximity with a tapered configuration or the like to accordingly initiate and thereby control the support provided by the stop 1122 at an earlier or later point in rotation of the second upright portion 1132 relative to the first upright portion 1130. In various examples, according to the specifications of a seat assembly, the joint assemblies described herein are constructed with various profiles of the stop interfaces, nose (where present), stop gap or the like to accordingly initiate engagement between the stop interfaces at a specified rotational position during rotation of the second upright portion and corresponding deformation of the pliable backrest 106.

Additionally, in other examples, the stop interfaces are profiled, for instance, with tapers, angles or the like to accordingly initiate and graduate the support provided based on the rotation of the second upright portion. For instance, with an angled configuration (shown in the seventh example from the left in FIG. 8), with the stop interfaces angled downwardly, the stop interfaces 1124 provide a graduated support that increases at a decreased rate relative to the flat orientation shown in FIG. 11B. In an example with downwardly angled stop interfaces the interfaces slide across one another as the second upright portion rotates, for instance, in a counterclockwise direction. The sliding engagement between the stop interfaces facilitates the graduated application of support (e.g., counterforce or counter moment) of the stop at the joint assembly 1121.

Figure 12:
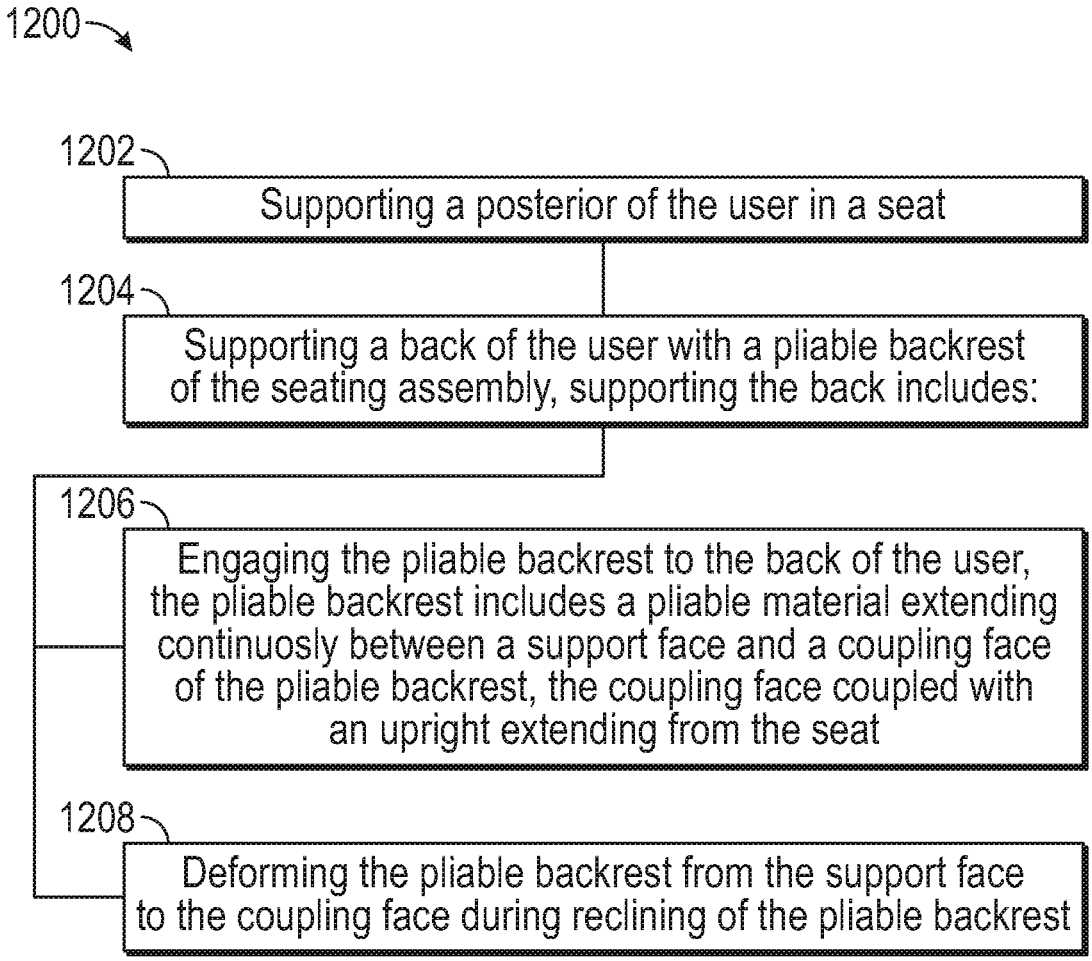
FIG. 12 is a block diagram showing one example of a method of supporting a user with a seat assembly.

FIG. 12 shows one example of a method 1200 for supporting a user in a seating assembly such as the seating assembly 100 previously described and shown herein. In describing the method 1200, reference is made to one or more components, features, functions or the like described herein. Where convenient, reference is made to the components, features, functions or the like with reference numerals. Reference numerals provided are exemplary and are not exclusive. For instance, the features, components, functions or the like described in the method 1200 include, but are not limited to, the corresponding numbered elements, other corresponding features described herein, both numbered and unnumbered, as well as their equivalents. At 1202, the method 1100 includes supporting a posterior of the user or occupant along the seat 102 (e.g., see FIG. 1). A seat pan 300, in one example, is a component of the seat 102 and coupled with the base housing 302 shown, for instance, in FIG. 3.

At 1204, a back of the user or occupant is supported with a pliable backrest 106 of the seating assembly 100. In various examples, supporting of the back includes at 1206 engaging the pliable backrest 106 to the back of the user or occupant. The pliable backrest 106 includes a pliable material extending between a support face 120 and a coupling face 122 of the pliable backrest 106. In one example, the pliable material extends continuously between the support face 120 and the coupling face 122. For instance, as shown in FIG. 4B, the pliable material extends continuously from the support face 120 to the upright member 112. In an example, one or more pliable pillars 124 are included with the pliable backrest 106 and facilitate deformation of the pliable backrest 106 between the support face 120 and the upright member 112, At 1208, supporting the back of the occupant includes deforming the pliable backrest 106 from the support face 120 to the coupling face 122 during one or more movements of the occupant and the pliable backrest 106. For instance, as shown in FIGS. 5A-D, the pliable backrest 106 is movable between first, second, third and fourth example deformation configurations and deforms, in one example, from the support face 120 to the coupling face 122. Optionally, deformation along the coupling face 122, in various examples, includes filling of a deformation gap 126 between the upright member 112 and a support span 128 extending between one or more pliable pillars 124 (see FIG. 5A). In other examples, deforming the pliable backrest 106 from the support face to the coupling face includes deformation of one or more lateral or vertical wings 200, 202, respectively. Examples of wing deformation are shown in each of FIGS. 5B and 5C. The vertical wing 202 is shown deflected in each of FIGS. 5A and 5D.

In another example, supporting the back of the user or occupant includes preloading an upright bracket, for instance, with one or more biasing elements such as biasing struts. As described herein, the biasing struts are optionally preloaded during assembly of the seating assembly 100. For instance, as shown in FIG. 3, the biasing elements are, in one example, preloaded during coupling of the seat pan 300 to the base housing 302. In another example, preloading is further shown in FIGS. 21A-21C and includes, for instance, the tightening of one or more fasteners between the base housing and the seat pan to automatically deform the biasing elements coupled between the base housing and the seat pan while at the same time assembly the seating assembly 100.

Figure 13:
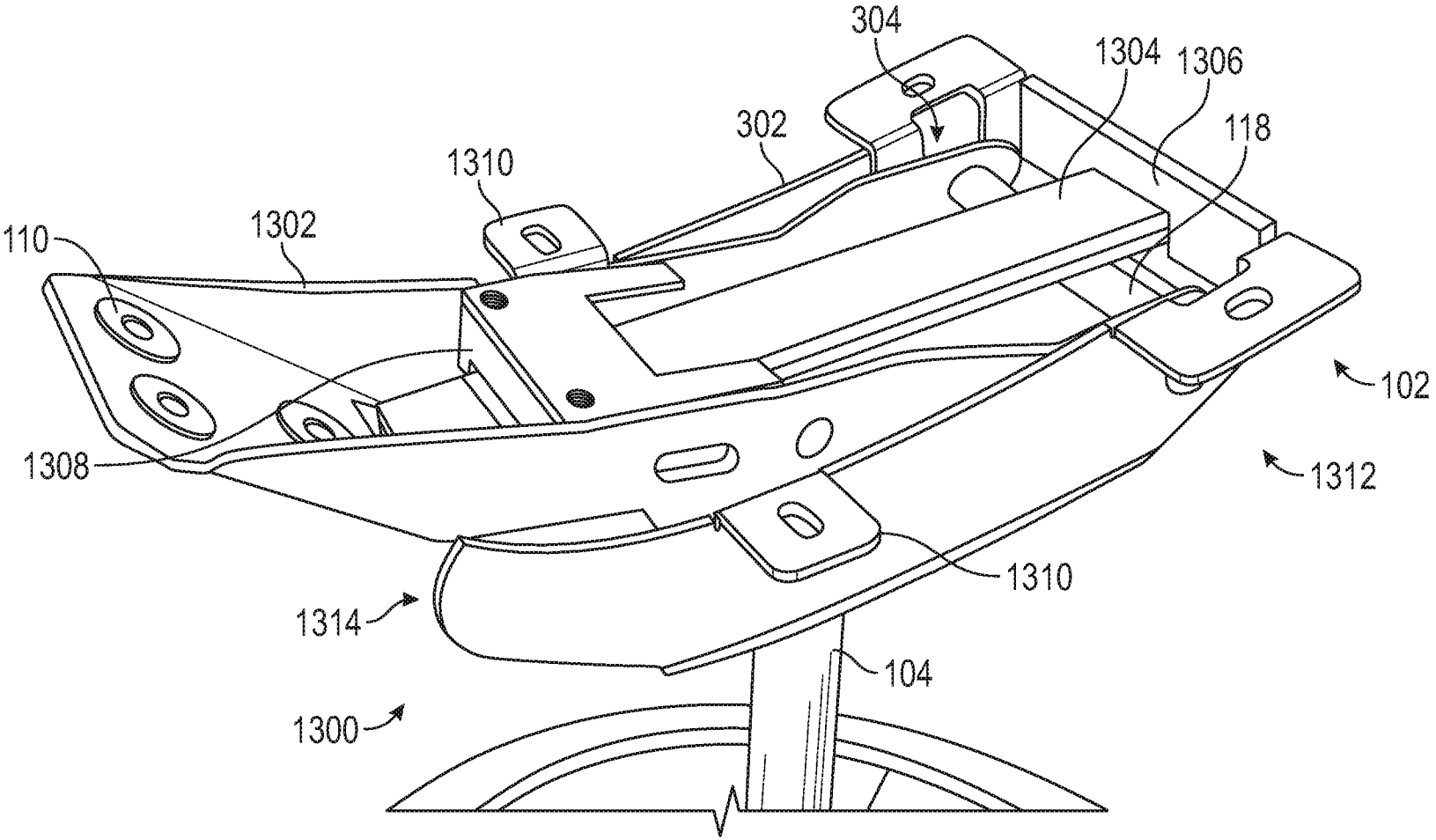
FIG. 13 is a perspective view of one example of a seat including a base housing and an upright bracket.

FIG. 13 shows one example of a seating assembly 1300 including a base housing 302 coupled with an upright bracket 110 of the upright 108 previously shown in FIG. 1. The upright bracket 110 is, in one example, preloaded, for instance, with a force, moment or the like provided by a biasing element such as the biasing strut 1304 (e.g., one or more leaf springs, coil springs, torsion bars, torsion springs, elastomeric elements or the like). A seat pan is generally coupled along the base housing 302 to assemble the seat 102. In this example, the seat pan is removed to facilitate observation of the base housing 302 and the upright bracket 110.

As shown in FIG. 13, a bracket arm 1302 of the upright bracket 110 is rotatably coupled with the base housing 302 with a pivot hub 118 seated within a pivot socket 304 of the base housing 302, As further shown in FIG. 13, the bracket arm 1302 of the upright bracket 110 includes a distal strut anchor 1308 configured for coupling with the biasing strut 1304. For instance, as shown in FIG. 13, one of the ends of the biasing strut 1304 is received in the distal strut anchor 1308. As further shown in FIG. 13, the upright bracket 110, when coupled with the base housing 302, includes the distal strut anchor 1308 proximate to a seat rear 1314 of the seating assembly 1300.

As further shown in FIG. 13, the upright bracket 110 is coupled with the base housing 302 at the pivot socket 304. As further shown in FIG. 13, the base housing 302 surrounds a portion of the upright bracket 110 including, for instance, portions of the bracket arms 1302 extending from the pivot hub 118 to the distal strut anchor 1308. The base housing 302 includes one or more pan brackets 1310 configured for coupling with a seat pan coupled along the pan brackets 1310 and over the upright bracket 110. As will be described herein, the coupling of the seat pan with the base housing 302 automatically preloads the biasing strut 1304 to accordingly provide a specified preload to the upright bracket 110 as well as the upright member 112 coupled there along. The base housing 302 and the seat pan house and conceal the biasing strut 1304, and in some examples provide at least a partial enclosure for the biasing strut 1304 during preloading thereby minimizing access to the biasing strut 1304 during preloading and use of the seating assembly 1300.

As further shown in FIG. 13, the base housing 302 includes a proximal strut anchor 1306 sized and shaped to couple with the biasing strut 1304, for instance, at an opposed end of the seating assembly 1300 relative to the distal strut anchor 1308 provided with the upright bracket 110. In an example, the biasing strut 1304 extends from the proximal strut anchor 1306 of the base housing 302 to the distal strut anchor 1308 of the upright bracket 110. Optionally, one or more features of the base housing 302 provides additional support or initiates mechanical deflection of the biasing strut 1304. In this example, the pivot hub 118 extends across the pivot sockets 304 and is interposed between the proximal and distal strut anchors 1306, 1308. The pivot hub 118 acts as the fulcrum for deflection of the biasing strut 1304 during each of preloading and rotation of the upright bracket 110 during movement of the pliable backrest 106 (e.g., during reclining).

Figure 14:
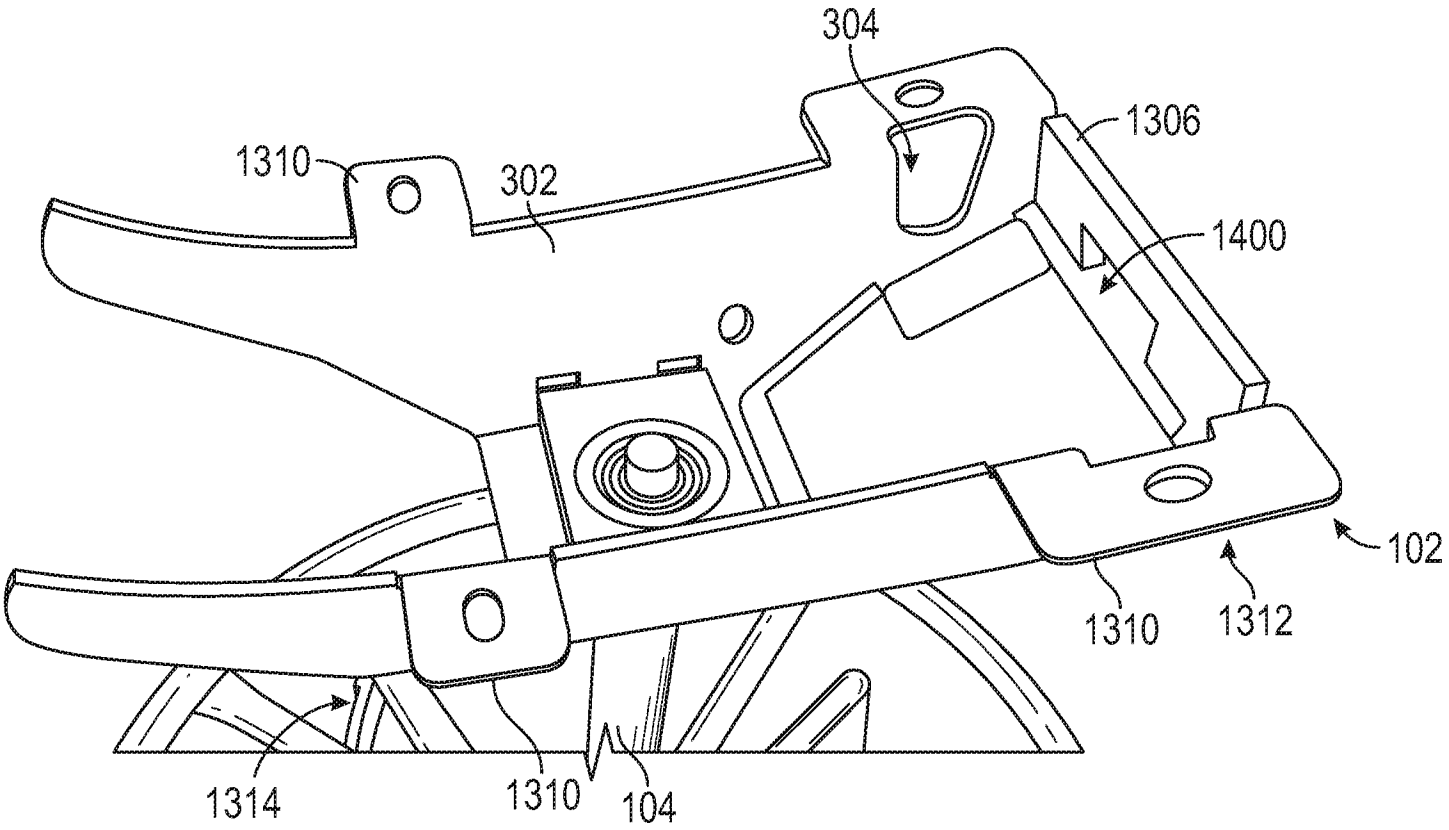
FIG. 14 is a perspective view of one example of the base housing of FIG. 13.

In the example shown in FIG. 13, the pivot socket 304 and the proximal strut anchor 1306 are provided proximate to a seat front 1312 of the seating assembly 1300. Accordingly, the upright bracket 110 extends from the pivot hub 118 of the base housing 302 rearwardly toward the distal strut anchor 1308. Proximate to the distal strut anchor 1308, an upright member 112 (shown in FIGS. 1, 2A, 2B) is coupled to the upright bracket 110 and, in turn, coupled with the pliable backrest 106. Accordingly, with reclining of the pliable backrest 106, the upright member 112 as well as the upright bracket 110 rotate relative to the pivot socket 304. The preloaded biasing strut 1304, further described herein deflects and supports the reclining movement. For example, the preloaded biasing strut opposes the reclining movement to provide a supported comfortable feel to the occupant along the backrest 106. Further, the preload and additional deflection of the biasing strut 1304 provides a return bias to the upright bracket 110, the upright member 112 and the pliable backrest 106 to return the backrest 106 to a neutral or initial preloaded configuration as the occupant sits up in the seating assembly 1300. Referring now to FIG. 14, a perspective view of the base housing 302 is shown with the upright bracket 110 decoupled from the base housing. As further shown in FIG. 14, the proximal strut anchor 1306 provides, in this example, an anchor recess 1400 configured for coupling with a portion of the biasing element, for instance, the biasing strut 1304 shown in FIG. 13. In an example, an end of the biasing strut is received in the anchor recess 1400 and is engaged on one or more sides of the biasing strut to accordingly limit or constrain lateral movement of the biasing element during operation of the seating assembly 1300, for instance, during reclining, tilting, twisting movement or the like of the occupant.

In another example, the proximal strut anchor 1306 includes one or more coupling features including, but not limited to, clamps, fittings, interference fits, pins and sockets or the like configured to grasp and retain the portion of the biasing strut 1304 coupled with the proximal strut anchor 1306, In one example, the proximal strut anchor 1306 including the anchor recess 1400 or other coupling features are configured to prevent both lateral and axial motion of the biasing strut 1304. The anchor recess 1400, other coupling features or the like (e.g., associated with one or more of the strut 304 or the base housing 302) cooperate to anchor the biasing strut 1304 at the proximal strut anchor 1306.

Figure 15:
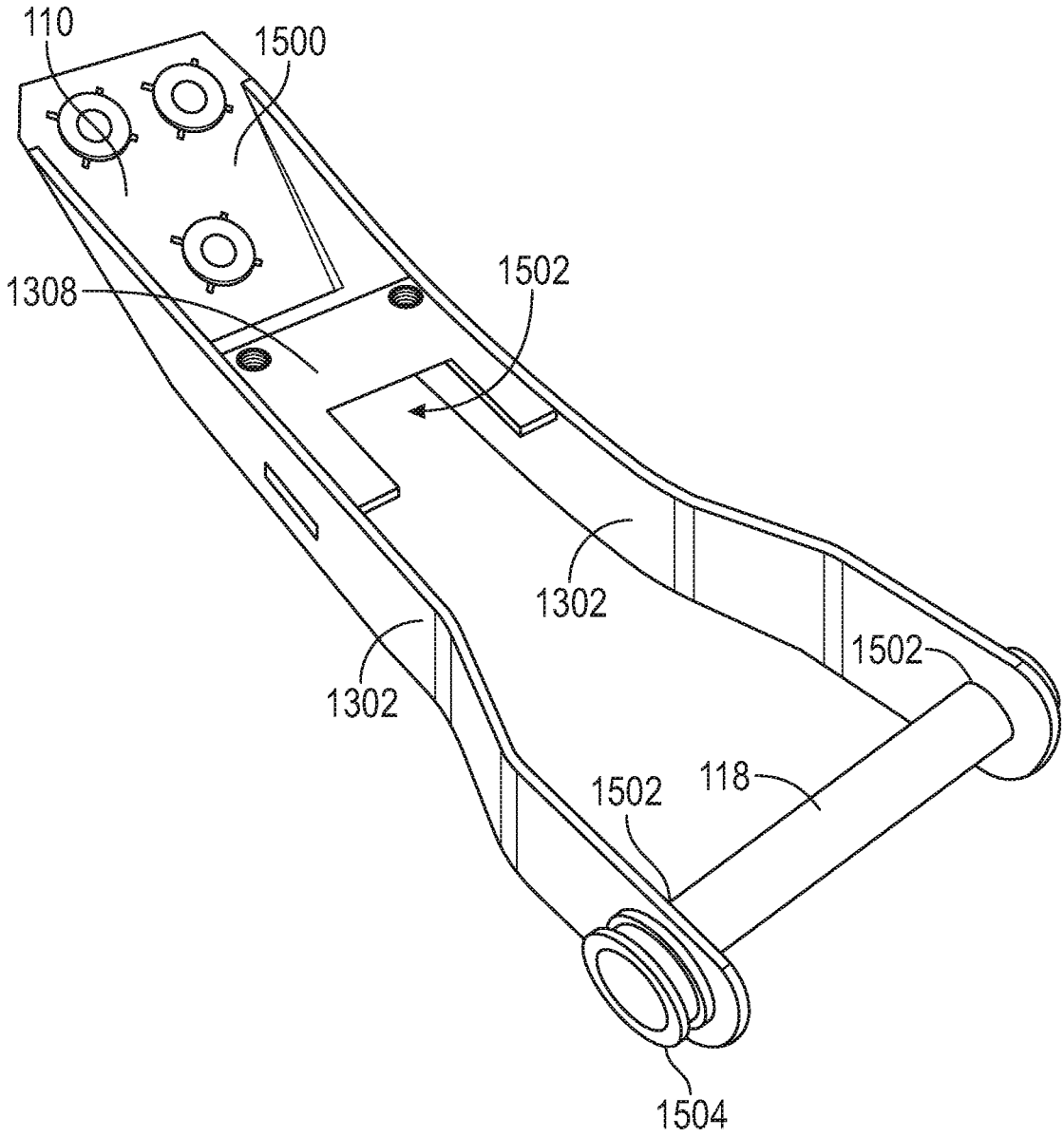
FIG. 15 is a perspective view of one example of the upright bracket of FIG. 13.

FIG. 15 is a perspective view of the upright bracket 110 removed from the base housing 302. The upright bracket 110 includes bracket arms 1302 extending from a pivot hub 118 to an upright installation flange 1500. The upright installation flange 1500 is configured for coupling with one or more other components of the seating assembly, for instance, the upright member 112 previously shown in FIGS. 1, 2A, 2B. Optionally, the bracket arms 1302 are provided in a spaced configuration relative to the pivot hub 118. The bracket arms 1302 spaced from one another provide a wide base for the upright bracket 110 and well as the upright member 112 and the pliable backrest 106. The wide base supports the pliable backrest 106 and flexion in the upright bracket 110 and the upright member 112 is minimized. Instead, deformation of the assembly of the bracket 110, member 112 and the pliable backrest 106 is localized to the pliable backrest 106 with the pliable material extending between the support and coupling surfaces as previously described herein.

In another example, the upright bracket 110 substantially constrains motion of the upright bracket 110 and the upright member 112 to rotational movement, for instance, around the pivot hub 118. As shown in FIG. 15, one or more bearings 1504 (e.g., bushings or the like) are provided at either end of the pivot hub 118 for coupling with corresponding features of the base housing 302, such as the pivot socket 304.

As further shown in FIG. 15, the upright bracket 110 includes the distal strut anchor 1308. In this example, the distal strut anchor 1308 is provided proximate to the upright bracket 110. The distal strut anchor 1308 optionally includes an anchor recess 1502. The anchor recess 1502, in one example, is similar to the anchor recess 1400 associated with the proximal strut anchor 1306. For instance, the anchor recess 1502 includes opposed walls, projections or the like configured to constrain lateral movement of the biasing strut 1304 relative to the upright bracket 110. In another example, the distal strut anchor 1308 includes one or more coupling features configured to constrain lateral and axial movement of the biasing strut 1304. The coupling features include the features previously described with the anchor recess 1400, for instance one or more of clamps, fittings, interference fits, pins and sockets or the like configured to grasp and retain the biasing strut 1304 at the distal strut anchor 1308.

The biasing strut 1304 extends from the proximal strut anchor 1306 associated with the base housing 302 to the distal strut anchor 1308 of the upright bracket 110. Reception of the biasing strut 1304 at the distal strut anchor 1308 and proximal strut anchor 1306 couples and retains the biasing strut 1304 in position, for instance, during reclining movement, preloading of the biasing strut 1304 or the like. In another example, a portion of the biasing strut between the opposed ends of the biasing strut 1304 is born by another component of the seating assembly 1300 such as the pivot hub 118. In one example, the pivot hub 118 acts as a fulcrum configured to maintain and enhance loading of the biasing strut 1304, for instance, during reclining movement of the upright bracket 110. In a configuration including one or more leaf springs as the biasing strut 1304, the pivot hub 118 initiates and controls deflection of the strut 1304 between the anchors 1306, 1308 during preloading and use of the seating assembly 1300.

Figure 16A:
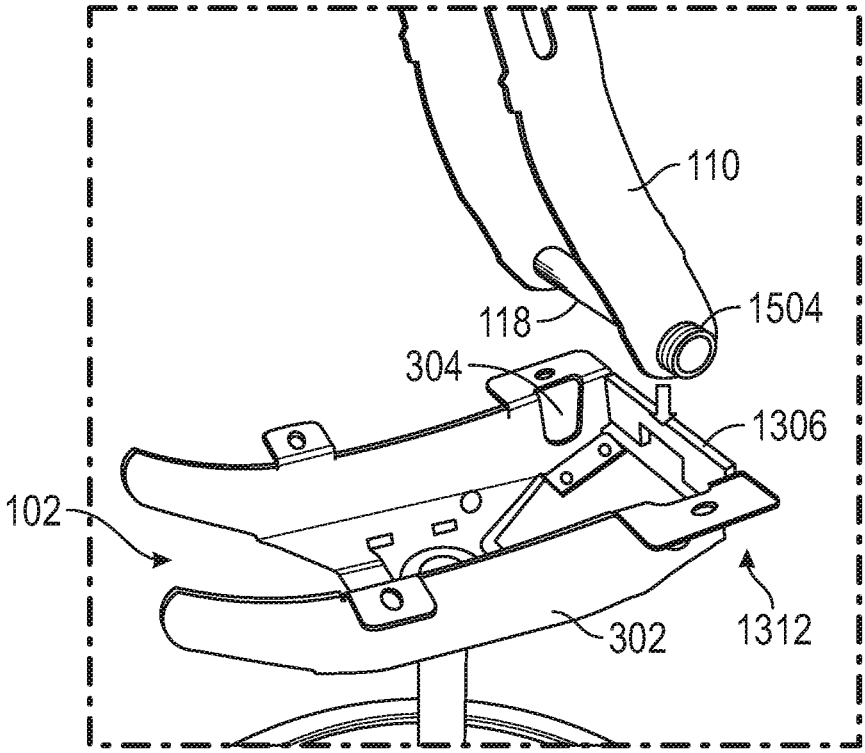
FIG. 16A is a first perspective view of coupling of the upright bracket with the base housing.

FIGS. 16A, B show one example of a first intermediate installation configuration of the seating assembly 1300. Referring first to FIG. 16A, the base housing 302 and the upright bracket 110 are shown in an exploded configuration just prior to coupling of the upright bracket 110 with the base housing 302. As shown, the bearings 1504 and pivot hub 118 are suspended above the pivot socket 304 of the base housing 302, In an example, the pivot sockets 304 include a tapered profile configured to receive the bearings 1504 therein and facilitate the rotatable coupling of the upright bracket 110 to the base housing 302. As further shown in FIG. 16A, the pivot sockets 304 of the base housing 302 are, in this example, located proximate to the seat front 1312.

Figure 16B:
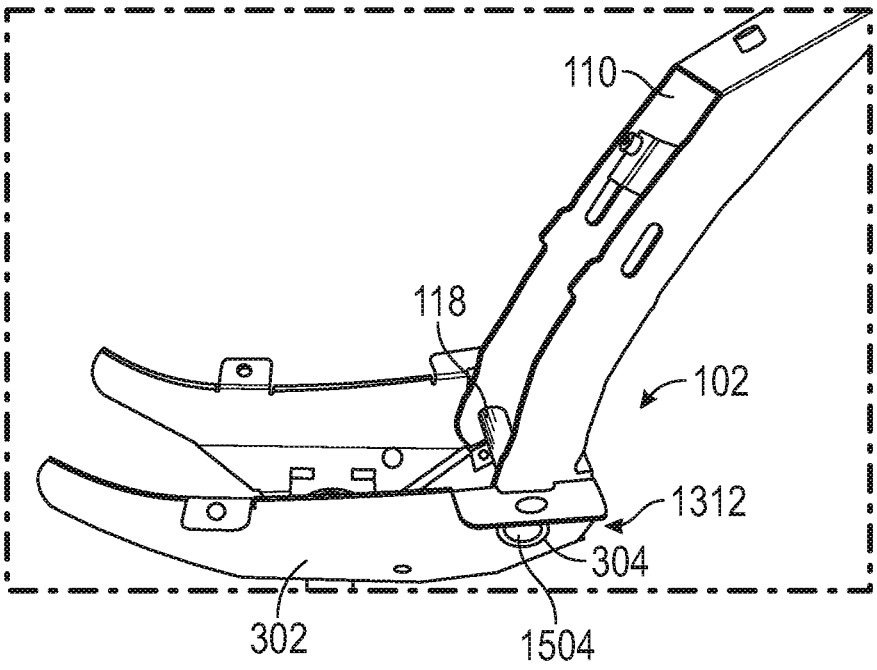
FIG. 16B is a second perspective view of coupling of the upright bracket with the base housing.
Figure 17A:
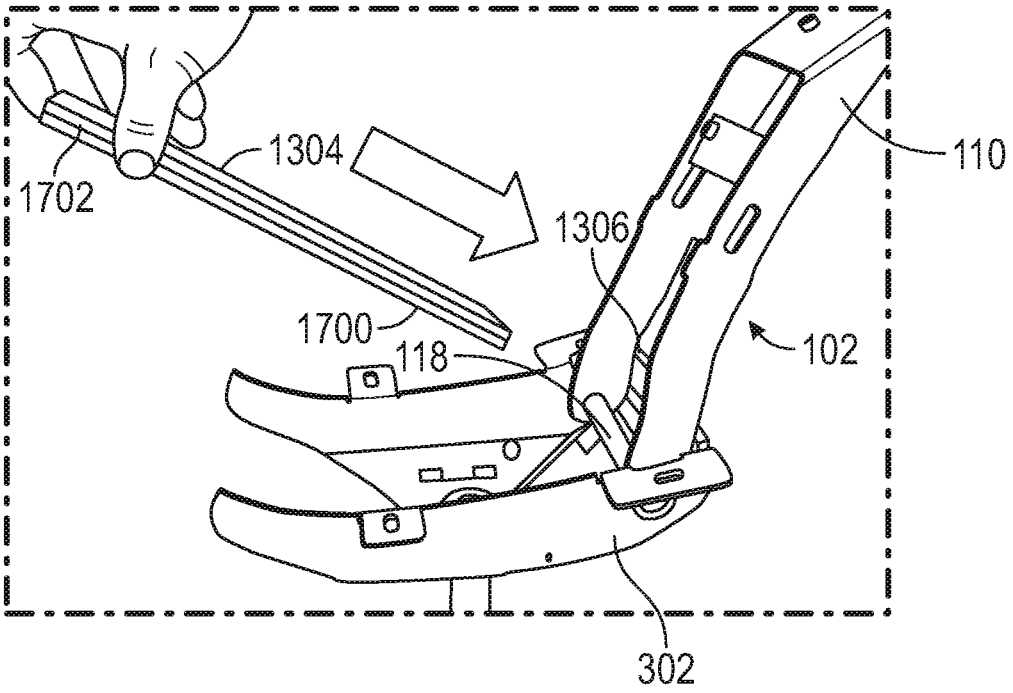
FIG. 17A is a first perspective view of positioning of an unloaded biasing element in the seat.
Figure 17B:
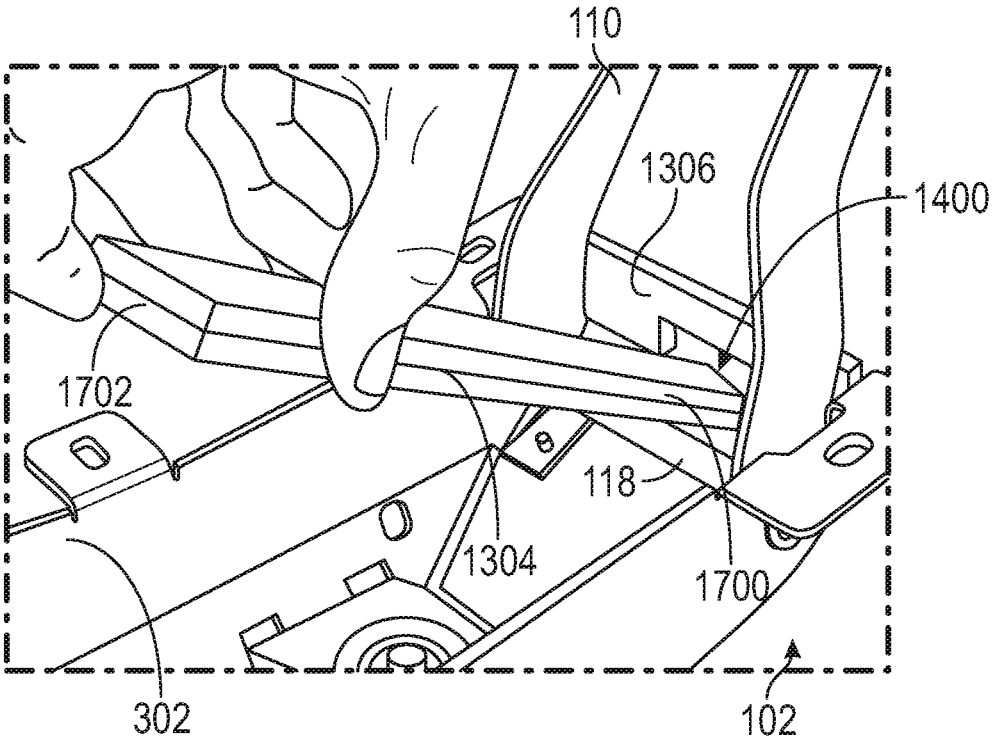
FIG. 17B is a second perspective view of positioning of the unloaded biasing element in the seat.
Figure 17C:
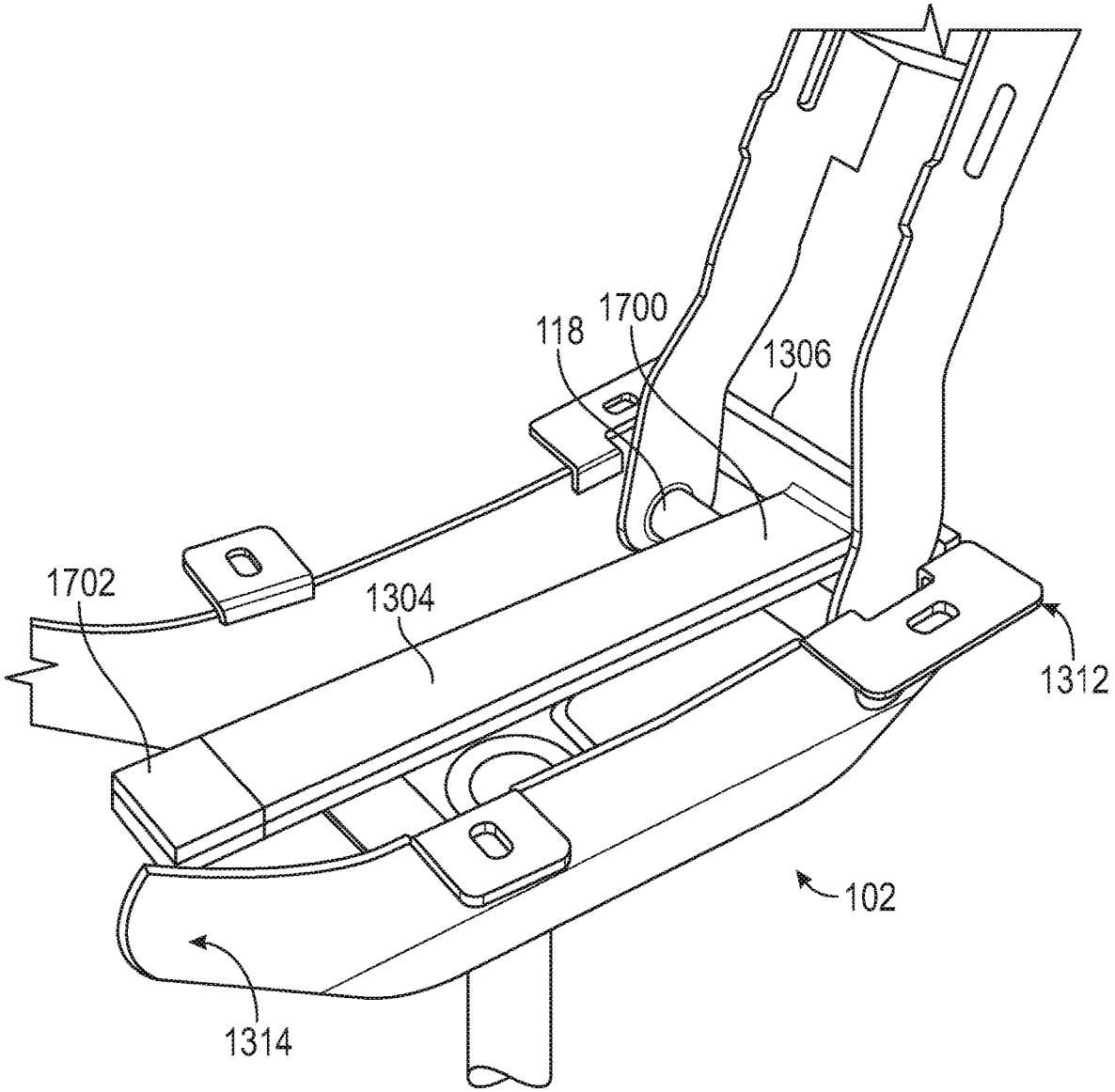
FIG. 17C is a third perspective view of positioning of the unloaded biasing element in the seat.

Referring now to FIG. 16B, the upright bracket 110 is shown coupled with the base housing 302 at the pivot sockets 304 proximate to the seat front 1312. The pivot hub 118 including, for instance, the bearings 1504 provided at either end of the pivot hub 118, is positioned within the pivot sockets 304 thereby facilitating rotatable coupling of the upright bracket 110 to the base housing 302. In this configuration, the upright bracket 110 is raised and ready for reception of the biasing element (e.g., biasing strut 1304) as further described herein. Referring now to FIGS. 17A-C, the seat 102 is shown in another intermediate configuration, for instance, with the biasing strut 1304 installed between the upright bracket 110 and the base housing 302. Referring first to FIG. 17A, the biasing strut 1304 is shown in a decoupled position relative to each of the base housing 302 and the upright bracket 110. The biasing strut 1304 in this example is an elongate member such as one or more stacked leaf springs having a proximal strut portion 1700 and a distal strut portion 1702. The proximal strut portion 1700 proximate to the proximal strut anchor 1306 of the base housing 302.

FIG. 17B shows a detailed view of the base housing 302 and the upright bracket 110 as the biasing strut 1304 is coupled therebetween. As shown, the proximal strut portion 1700 is inserted into a spaced between the proximal strut anchor 1306 and one or more other components including, for instance, the pivot hub 118 of the upright bracket 110. The proximal strut portion 1700 is inserted between the proximal strut anchor 1306 and the pivot hub 118. As further shown in FIG. 17B, the proximal strut anchor 1306 includes a coupling feature, such as the anchor recess 1400 configured to receive and retain the biasing strut 1304 therein.

As further shown in FIG. 17C, the biasing strut 1304 is shown with the distal strut portion 1702 provided proximate the seat rear 1314. As shown, the biasing strut 1304 is provided in a cantilevered configuration with the proximal strut portion 1700 retained between the proximal strut anchor 1306 of the base housing 302 and the pivot hub 118. The distal strut portion 1702 is accordingly suspended and ready for coupling with the upright bracket 110 as shown, for instance, in FIG. 18. The biasing strut in this position is in a passive loaded configuration, for instance, with the biasing strut 1304 under minimal load (e.g., including minimal or no torque or force loading), because of gravity or because of initial engagement of the upright bracket 110 to the distal strut portion 1702 (shown in FIG. 18).

Figure 18:
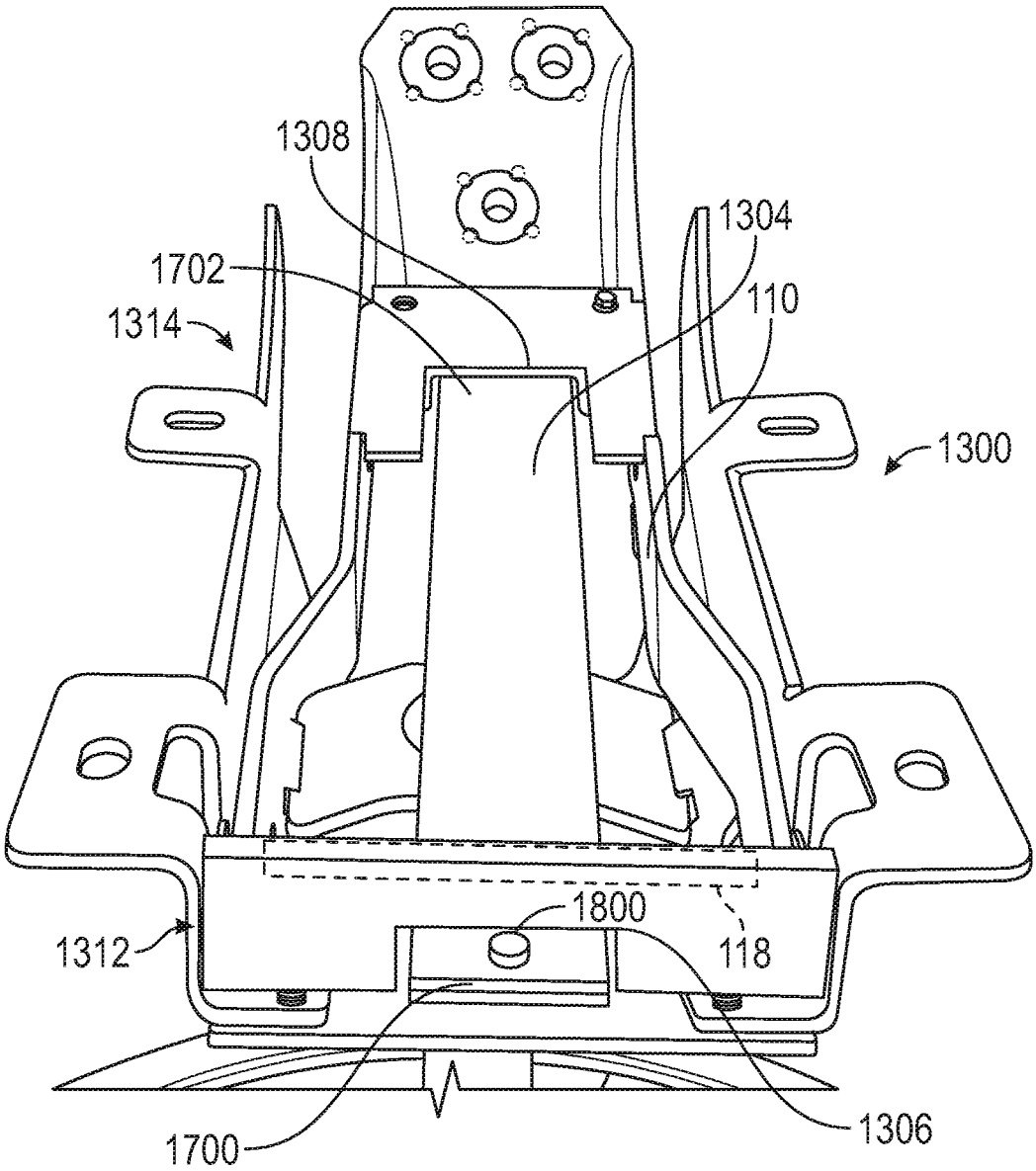
FIG. 18 is a perspective view of the biasing element indexed to the seat with one example of indexing features.

Referring now to FIG. 18, the biasing strut 1304 is provided in a coupled configuration between the upright member 110 and the base housing 302. For instance, in this example, the biasing strut 1304 is coupled with the distal strut anchor 1308 and the proximal strut anchor 1306. The upright bracket 110 is rotated from the position shown in Figure T7C to the lowered position shown in FIG. 18. Rotation of the upright bracket 110 engages the distal strut anchor 1308 with the distal strut portion 1702 of the biasing strut 1304. As further shown in FIG. 18, the pivot hub 118 is an interposing feature between the proximal and distal strut portion 1700, 1702 of the biasing strut 1304. In this example, the upright bracket 110 coupled with distal strut portion 1702 of the biasing strut 1304 applies a minimal load to the biasing strut 1304 (another example of a passive loaded configuration) prior to preloading as further described herein.

The seating assembly 1300 shown in FIG. 18 includes another example of a coupling feature configured to retain the biasing strut 1304 in a specified location, orientation or the like relative to one or more of the base housing 302 or the upright bracket 110. As shown in FIG. 18, the coupling feature includes, but is not limited to an indexing boss 1800 projecting from the biasing strut 1304. The biasing strut 1304 is captured between the proximal and distal strut anchors 1306, 1308. The indexing boss 1800 is proximate to the proximal strut anchor 1306, and constrains axial translation of the strut 1304 toward the distal strut anchor 1308. Instead, the indexing boss 1800 is intercepted by the proximal strut anchor 1306, thereby retaining the strut in the position shown in FIG. 18.

Figure 19A:
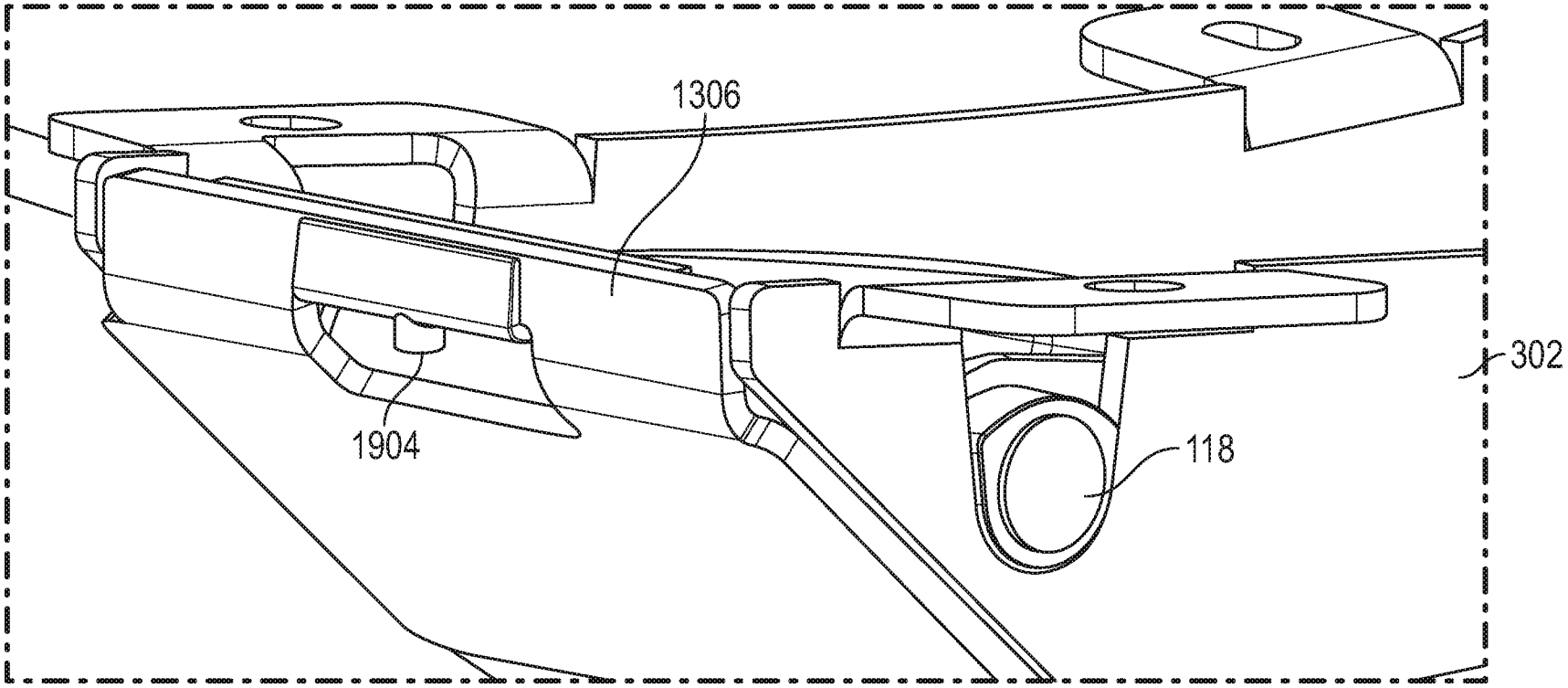
FIG. 19A is a first perspective view of another example of indexing features for the biasing element and the seat.
Figure 19B:
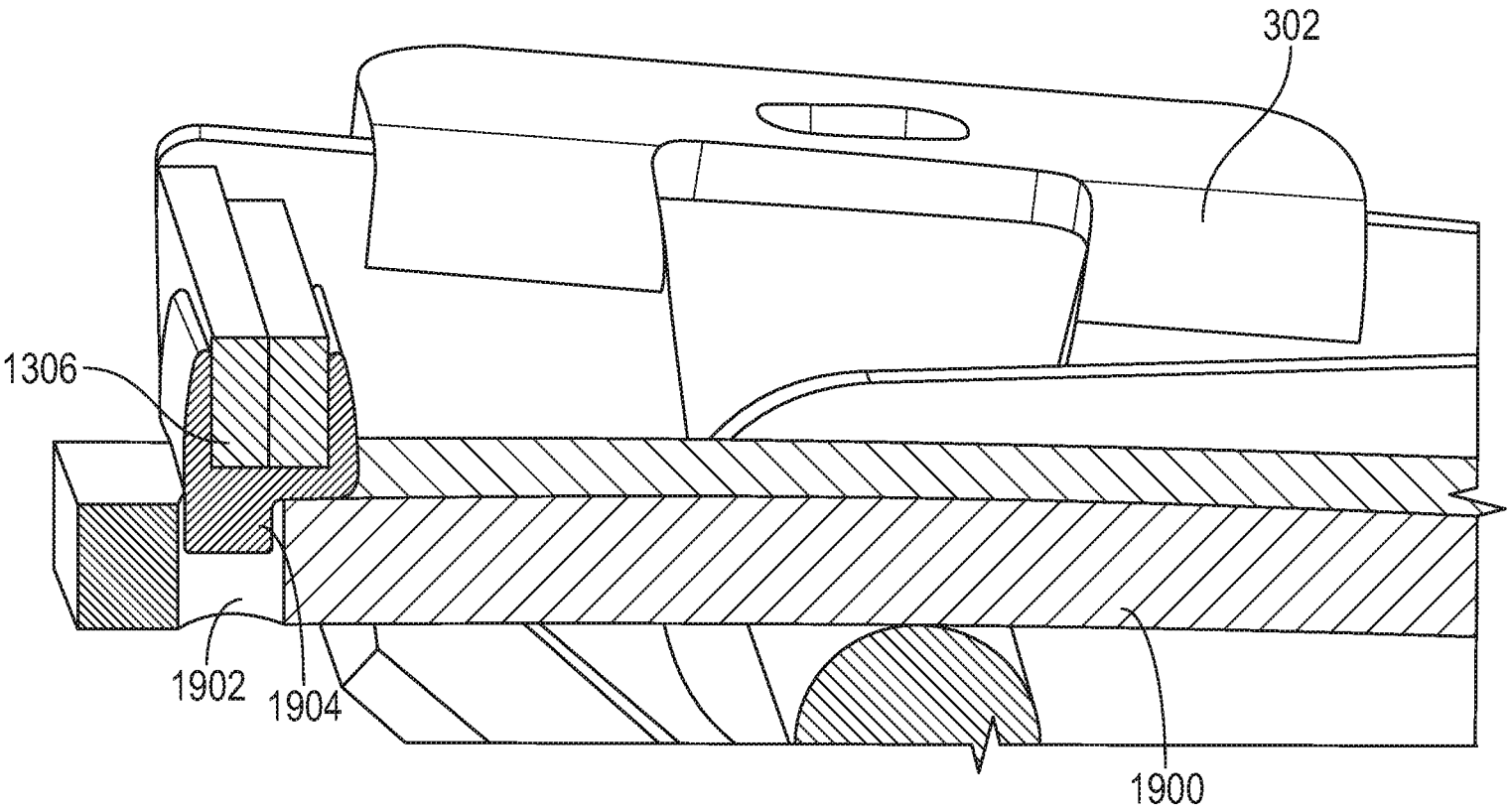
FIG. 19B is a second perspective view of the indexing features of FIG. 20A.

FIGS. 19 A, B show another example of the biasing strut 1900 or coupling features configured to couple and retain the biasing strut 1900 in an installed configuration. As shown in FIG. 19B, the biasing strut 1900 includes an indexing recess 1902 configured for reception of a corresponding coupling feature such as the indexing boss 1904 of the base housing 302, As shown in FIG. 19A, the proximal strut anchor 1306 includes the indexing boss 1902 and, in this example, the indexing boss 1902 extends into the profile of the anchor recess 1400, previously shown in FIG. 14.

FIG. 19B shows a detailed cross-section of the biasing strut 1900 and the base housing 302 including the coupling feature (e.g., indexing boss 1904 in this example). The indexing boss 1904 is seated in the indexing recess 1902 of the biasing strut 1900. The fitting of the indexing boss 1904 with the indexing recess 1902 retains at least the proximal portion of the biasing strut 1900 in the position shown in FIG. 19B, and accordingly minimizes axial or lateral movement of the strut 1900.

The indexing recess 1902 and indexing boss 1904 are one example of a coupling feature configured to retain the biasing strut 1900 in a specified location, for instance, between the base housing 302 and the upright bracket 110. In another example, a corresponding or similar coupling feature is provided at the distal strut portion 1702 to similarly retain the biasing strut 1900 proximate to the distal strut anchor 1308. While FIGS. 19A, 19B show' one example of a coupling feature, other examples of coupling features include, but are not limited to, one or more of clamps, retaining clips, cotter pins, interference fittings, pin and socket features or the like configured to constrain one or more of lateral and axial movement of the biasing strut 1900 relative to the other components of the seat 102 including, but not limited to, the base housing 302, upright bracket 110 or the like.

Figure 20A:
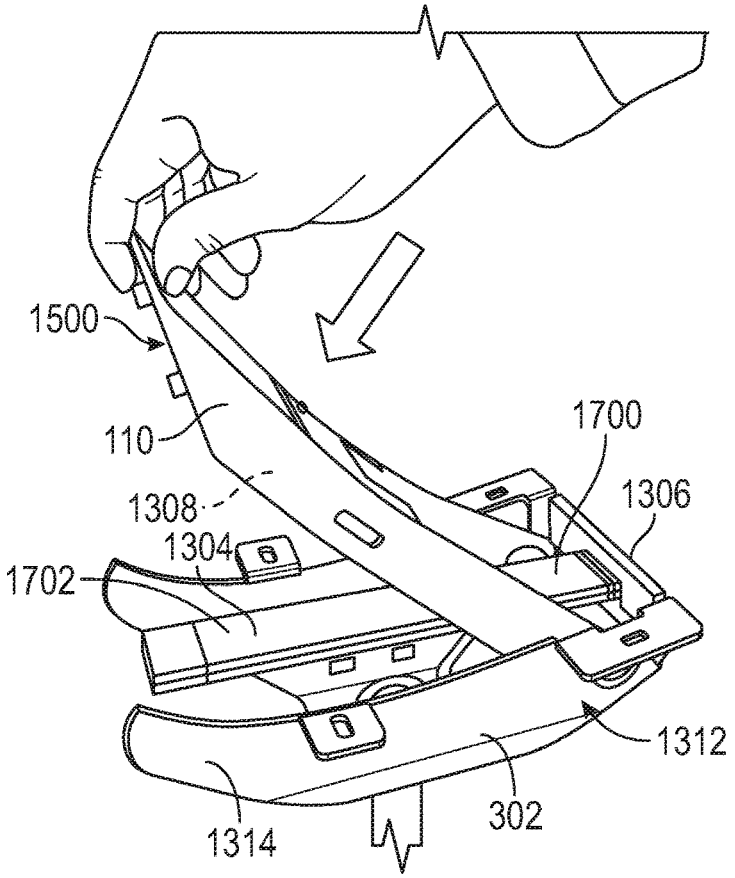
FIG. 20A is a perspective view of coupling of the upright bracket with the biasing element and capturing of the biasing element.
Figure 20B:
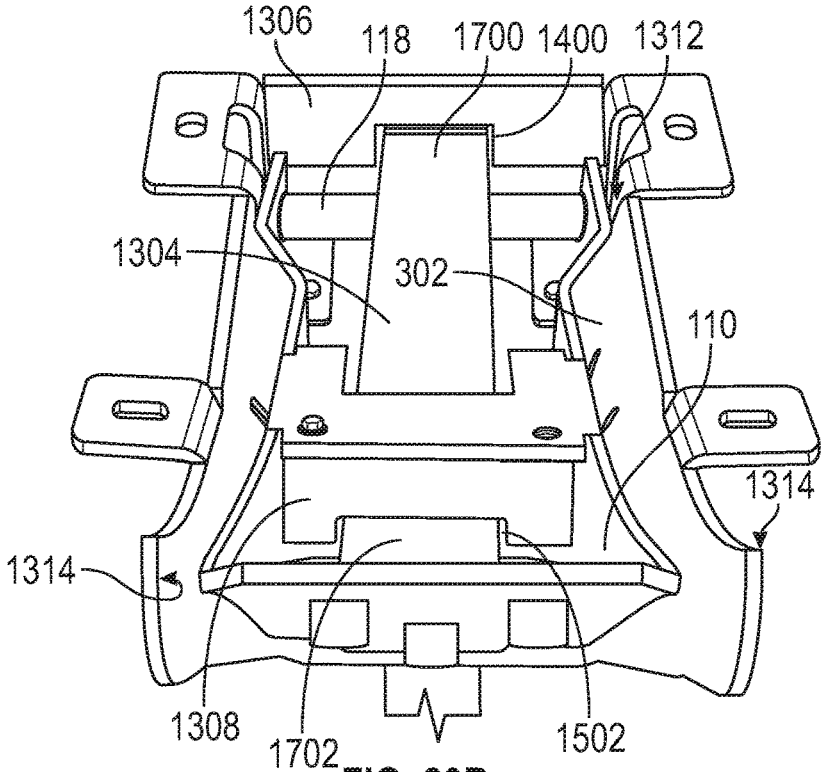
FIG. 20B is a first perspective view of the upright bracket coupled with the biasing element captured and in a passive preload configuration.
Figure 20C:
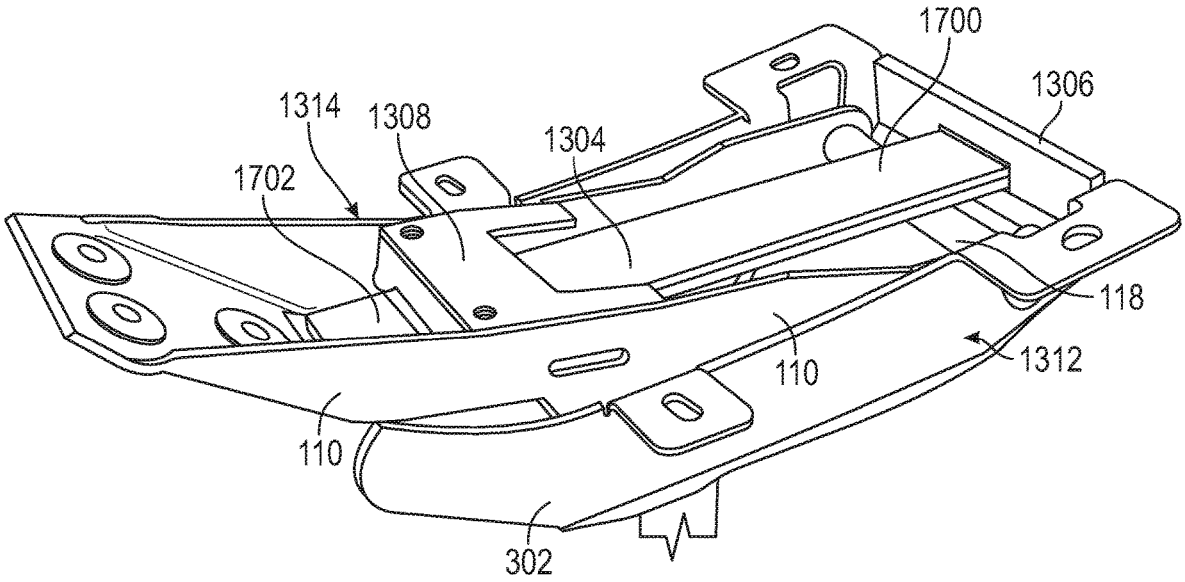
FIG. 20C is a second perspective view of the upright bracket coupled with the biasing element captured and in the passive preload configuration.

FIGS. 20A-C show the seat 102 prior to and ready for preloading. As shown in FIG. 20A, the upright bracket 110 is rotated toward the distal strut portion 1702 for engagement of the distal strut anchor 1308 with the upright bracket 110. FIG. 18 is a perspective view from the seat front 1312 showing the upright bracket 110 after completion of rotation with the distal strut anchor 1308 coupled with the distal strut portion 1702 of the biasing strut 1304.

FIG. 20B is a perspective view of the seat 102 from the seat rear 1314. The upright bracket 110 is shown in a passively preloaded configuration (as in FIG. 18) with the upright bracket 110 coupled with a distal strut portion 1702 of the biasing strut 1304 at the distal strut anchor 1308. The proximal strut portion 1700 is shown coupled with the proximal strut anchor 1306. In this example, each of the distal and proximal strut anchors 1308, 1306 include coupling features, such as recesses, cutouts, fittings or the like configured for reception of the corresponding portion of the biasing strut 1304 therein.

As shown in FIG. 20C, the pivot hub 118 is interposed between each of the proximal strut anchor 1306 and the distal strut anchor 1308 and accordingly forms a fulcrum or third contact point with the biasing strut 1304 to initiate controlled bending of the biasing strut 1304 to maintain a preload of the strut 1304 and provide the restoring bias and support to the pliable backrest 106.

Figure 21A:
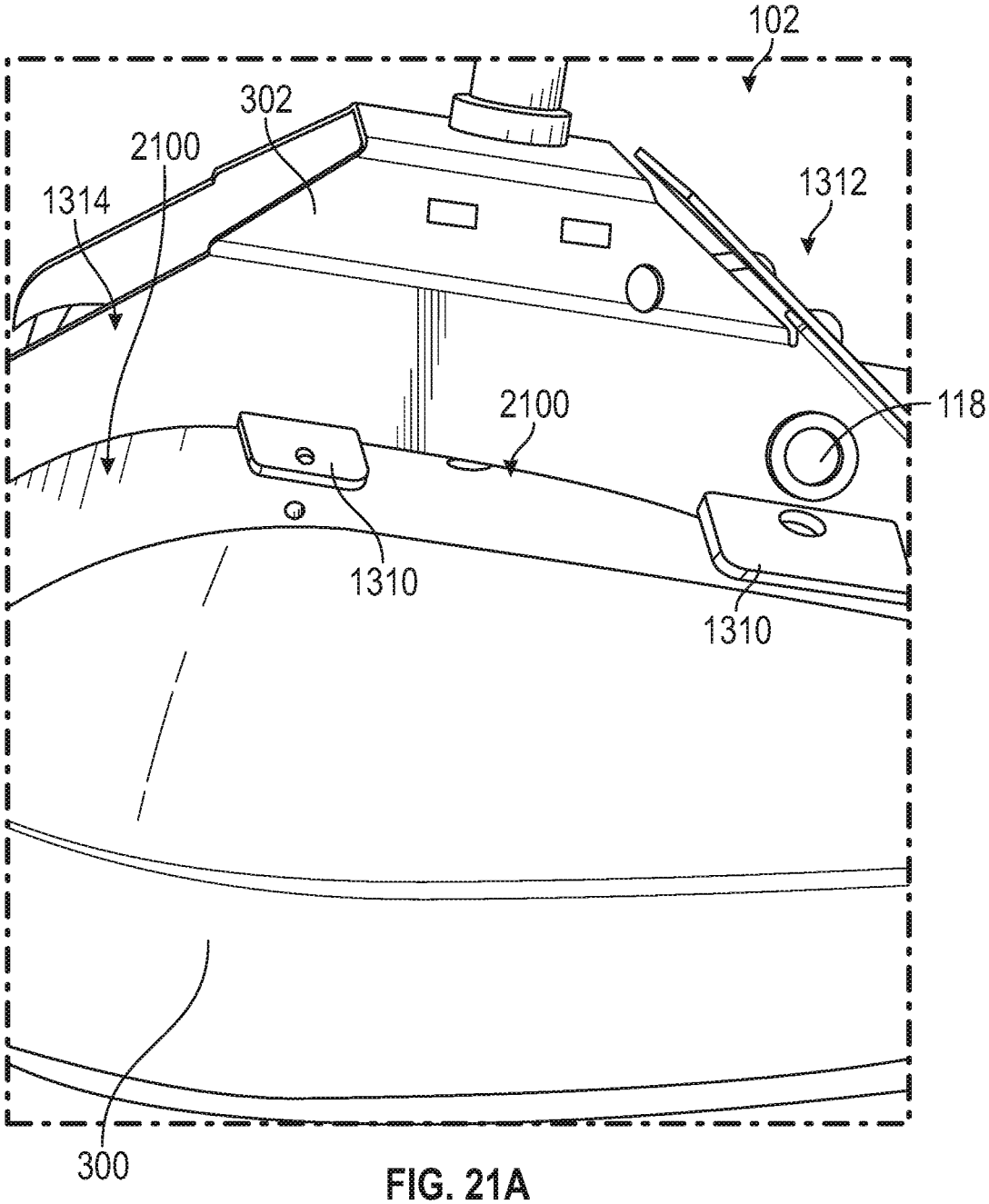
FIG. 21A is a perspective view of the base housing coupled with a seat pan with a preload spacing therebetween.
Figure 21B:
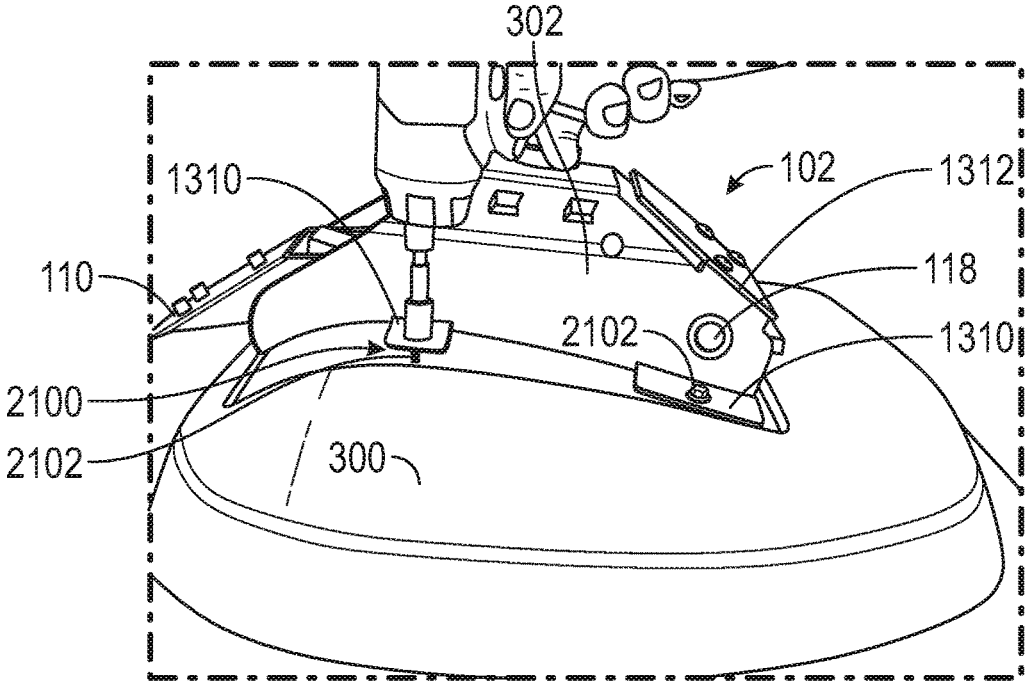
FIG. 21B is a perspective view of fastening of the seat pan to the base housing.
Figure 21C:
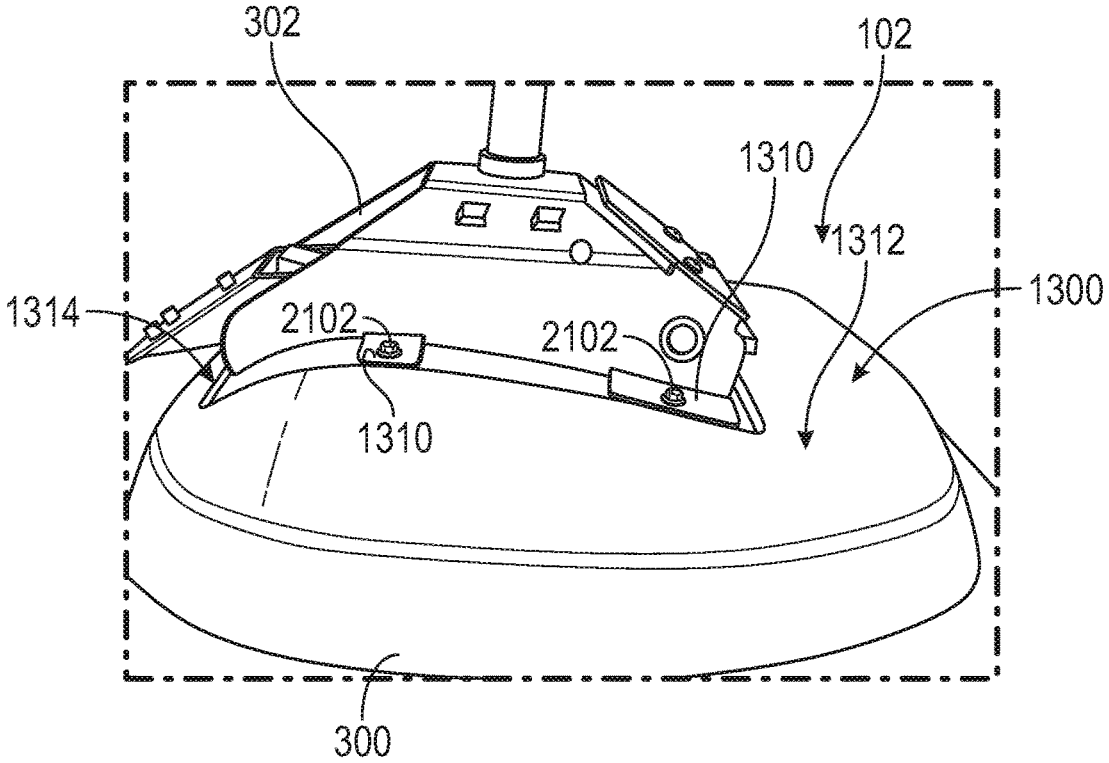
FIG. 21C is a perspective view of the seat pan fastened to the base housing, and the preload spacing is closed and the biasing element is in the preloaded configuration.

FIGS. 21A-C show one example of preloading of the biasing strut 1304 of the seating assembly 1300. As shown in FIG. 20A, the seat 102 is in an inverted orientation with the base housing 302 provided at an upper position relative to the inverted seat pan 300. As further shown, the base housing 302 is spaced from a portion of the seat pan 300 by a preload spacing 2100. The preload spacing 2100, in one example, is provided between the seat pan 300 and the base housing by the unloaded (including passively preloaded) biasing strut 1304 in the configuration shown, for instance, in FIGS. 20B, 20C. As shown in FIG. 20C the upright bracket 110 is partially elevated relative to the base housing 302 through engagement with the biasing strut 1304. This configuration is maintained (though inverted) in FIG. 21A and accordingly the base housing 302 is spaced from the seat pan 300 because of the biasing strut 1304 and the raised upright bracket 110.

As further shown in FIG. 21A, the base housing 302 includes a plurality of pan brackets 1310 provided at portions of the base housing to fix the base housing 302 to the seat pan 300. In the examples provided herein, the fastening of the pan brackets 1310 closes the preload spacing 2100 and automatically preloads to biasing strut 1304.

Referring now to FIG. 21B, a fastening device, such as a driver, power tool, hand tool or the like, fastens one or more seat fasteners 2102 between the pan brackets 1310 of the base housing 302 and the seat pan 300. The coupling of the base housing 302 (including the pan brackets 1310) with the seat pan 300 closes the preload spacing 2100. For example, the upright bracket 304 is deflected through the multi-point engagement between the upright member 110, the base housing 302 and one or more components associated with the seat 102 such as the pivot hub 118. Closing of the preload spacing 2100 deflects the biasing strut 1304 and imparts a preload, for instance, a specified moment, force or the like to the upright bracket 110

Referring now to FIG. 21C, the base housing 302 is shown in an assembled configuration with the seat pan 300. The preload spacing 2100 shown in FIG. 21A is closed with the seat fasteners 2102. The biasing strut 1304 is deflected, and in the preloaded configuration. In one example, the preload spacing 2100 provided by the biasing strut 1304 corresponds to a specified amount or degree of deflection configured to impart a specified preload to the biasing strut 1304. Closing of the preload spacing 2100 automatically imparts the specified preload to the biasing strut 1304 as a step in the assembly of the seat pan 300 to the base housing 302. The specified preload includes, but is not limited to, a bias, restoring force or the like configured to provide an occupant or manufacturer specified feel (e.g., feeling of support to the occupant), support or the like from the biasing strut to the upright bracket 110, the associated upright member 112 and the pliable backrest 106.

Because preloading of the biasing strut 1304 is conducted with the strut 1304 captured and at least partially covered by the base housing 302, one or more of unintended release, unpredictable unloading or the like is minimized (e.g., eliminated or minimized). Instead, the seating assembly 1300 including the base housing 302, the seat pan 300 and the upright strut covers the biasing strut 1304 throughout preloading. Complicated fixtures, assemblies, presses, tooling or the like are not needed to preload the biasing strut 1304. Instead, fastening of the seat pan 300 to the base housing 302 automatically preloads the biasing strut 1304 to the preloaded configuration. Further, maintenance of the seat 102 is enhanced with the base housing 302, seat pan 300 and upright bracket 110 in the preloaded configuration. For instance, with unfastening of the seat pan 300 from the base housing 302, the biasing strut 1304 is automatically and safely unloaded before the biasing element is accessible, for instance, for repair or removal. Instead, by-decoupling the base housing 302 from the seat pan 300, the biasing strut 1304 is automatically unloaded prior to access, thereby facilitating its safe removal from the seating assembly 1300.

VARIOUS NOTES & EXAMPLES

Example 1 can include subject matter, such as a seating assembly comprising: a seat; an upright coupled with the seat, the upright extends away from the seat; and a pliable backrest coupled with the upright and having a support face and a coupling face, the coupling face spaced from the support face, the pliable backrest includes: a pliable material extending continuously between the support and coupling faces, and the support face is a first exterior face of the pliable back rest and the coupling face is a second exterior face of the pliable back rest, and wherein the coupling face is spaced away from the upright with a deformation gap.

Example 2 can include, or can optionally be combined with the subject matter of Example 1, to optionally wherein the support face is a front most portion of the pliable backrest and the coupling face is the rear most portion of the pliable backrest.

Example 3 can include, or can optionally be combined with the subject matter of one or any combination of Examples 1 or 2 to optionally include wherein the pliable material includes an elastomeric foam.

Example 4 can include, or can optionally be combined with the subject matter of one or any combination of Examples 1-3 to optionally include wherein the pliable backrest is configured to deform into the deformation gap with flexion of the back of the user.

Example 5 can include, or can optionally be combined with the subject matter of one or any combination of Examples 1-4 to optionally include wherein the pliable backrest includes one or more pliable pillars extending from the coupling face to the upright.

Example 6 can include, or can optionally be combined with the subject matter of Examples 1-5 to optionally include wherein the one or more pliable pillars include a pliable pillar material the same or different than the pliable material of the pliable backrest, and the pliable pillar material extends from the coupling face to proximate the upright.

Example 7 can include, or can optionally be combined with the subject matter of Examples 1-6 to optionally include wherein the one or more pliable pillars taper from the coupling face toward the upright.

Example 8 can include, or can optionally be combined with the subject matter of Examples 1-7 to optionally include wherein the one or more pliable pillars includes first and second pliable pillars, and the coupling face of the pliable backrest includes a support span extending between the first and second pliable pillars across the deformation gap.

Example 9 can include, or can optionally be combined with the subject matter of Examples 1-8 to optionally include wherein pliable backrest includes at least neutral and deformed configurations: in the neutral configuration the pliable backrest is in an initial unbiased position, and in the deformed configuration at least a portion of the pliable backrest extending between the support face and the coupling face is deformed.

Example 10 can include, or can optionally be combined with the subject matter of Examples 1-9 to optionally include wherein in the deformed configuration the portion of the pliable backrest extending continuously between the support face and the coupling face is deformed.

Example 11 can include, or can optionally be combined with the subject matter of Examples 1-10 to optionally include wherein in the neutral configuration the pliable backrest includes a back contour plane, and in the deformed configuration the portion of the pliable backrest proximate the coupling face is recessed from the back contour plane and deformed toward the upright.

Example 12 can include, or can optionally be combined with the subject matter of Examples 1-11 to optionally include wherein the deformed configuration includes one or more of reclining, tilting, twisting or rotating configurations.

Example 13 can include, or can optionally be combined with the subject matter of Examples 1-12 to optionally include wherein the pliable backrest includes lateral wings extending laterally from a coupling with the upright, and the lateral wings include the pliable material.

Example 14 can include, or can optionally be combined with the subject matter of Examples 1-13 to optionally include wherein the lateral wings each include a pliable frame extending along perimeters of the lateral wings, the pliable frame includes the pliable material.

Example 15 can include, or can optionally be combined with the subject matter of Examples 1-14 to optionally include wherein the upright includes a joint assembly, the joint assembly includes: a pivot, and a stop.

Example 16 can include, or can optionally be combined with the subject matter of Examples 1-15 to optionally include wherein the upright is an elastic upright configured to correspondingly deform with deformation of the pliable backrest.

Example 17 can include, or can optionally be combined with the subject matter of Examples 1-16 to optionally include wherein the upright is an elastic upright configured to helically twist.

Example 18 can include, or can optionally be combined with the subject matter of Examples 1-17 to optionally include, wherein an upright pivot rotatably couples the upright with the seat.

Example 19 can include, or can optionally be combined with the subject matter of Examples 1-18 to optionally include a seating assembly comprising: a seat; a pliable backrest coupled with the seat and having a support face and a coupling face, the coupling face spaced from the support face, the pliable backrest includes: a pliable material extending between the support and coupling faces, and the support face is a first exterior face of the pliable back rest and the coupling face is a second exterior face of the pliable back rest; and an upright coupled between the seat and the pliable backrest, the upright includes: an upright member extending between the seat and the pliable backrest, and a joint assembly along the upright member, the joint assembly includes a pivot configured to promote rotation of a first upright portion of the upright relative to a second upright portion, and opposed stop interfaces configured to control rotation of the first upright portion relative to the second upright portion.

Example 20 can include, or can optionally be combined with the subject matter of Examples 1-19 to optionally include wherein the joint assembly is remote from the seat and proximate to the pliable backrest.

Example 21 can include, or can optionally be combined with the subject matter of Examples 1-20 to optionally include wherein the pivot includes a living hinge.

Example 22 can include, or can optionally be combined with the subject matter of Examples 1-21 to optionally include wherein the opposed stop interfaces include first and second stop interfaces, and the first upright portion includes the first stop interface, and the second upright portion includes the second stop interface.

Example 23 can include, or can optionally be combined with the subject matter of Examples 1-22 to optionally include wherein a nose couples the first and second stop interfaces.

Example 24 can include, or can optionally be combined with the subject matter of Examples 1-23 to optionally include wherein the joint assembly includes a stop gap extending from the pivot toward the first and second stop interfaces.

Example 25 can include, or can optionally be combined with the subject matter of Examples 1-24 to optionally include wherein the stop gap tapers from the pivot toward the first and second stop interfaces.

Example 26 can include, or can optionally be combined with the subject matter of Examples 1-25 to optionally include wherein the stop gap is filled with a bias insert interposed between the first and second stop interfaces.

Example 27 can include, or can optionally be combined with the subject matter of Examples 1-26 to optionally include wherein the joint assembly includes first and second pivot configurations: in the first pivot configuration at the pivot the first upright portion is at a first angle relative to the second upright portion, and the opposed stop interfaces are disengaged, and in the second pivot configuration at the pivot the first upright portion is at a second angle relative to the second upright portion, and the opposed stop interfaces are engaged.

Example 28 can include, or can optionally be combined with the subject matter of Examples 1-27 to optionally include wherein the coupling face is spaced away from the upright with a deformation gap.

Example 29 can include, or can optionally be combined with the subject matter of Examples 1-28 to optionally include wherein the pliable material includes an elastomeric foam.

Example 30 can include, or can optionally be combined with the subject matter of Examples 1-29 to optionally include wherein the pliable backrest includes one or more pliable pillars extending from the coupling face to proximate the upright, and the one or more pliable pillars include a pliable pillar material the same or different than the pliable material of the pliable backrest.

Example 31 can include, or can optionally be combined with the subject matter of Examples 1-30 to optionally include wherein the one or more pliable pillars includes first and second pliable pillars, and the coupling face of the pliable backrest includes a support span extending between the first and second pliable pillars.

Example 32 can include, or can optionally be combined with the subject matter of Examples 1-31 to optionally include wherein the upright is an elastic upright configured to correspondingly deform with deformation of the pliable backrest.

Example 33 can include, or can optionally be combined with the subject matter of Examples 1-32 to optionally include wherein the upright is an elastic upright configured to helically twist.

Example 34 can include, or can optionally be combined with the subject matter of Examples 1-33 to optionally include a method of supporting a user in a seating assembly comprising: supporting a posterior of the user in a seat; and supporting a back of the user with a pliable backrest having a support face spaced from a coupling face, supporting the back includes: engaging the pliable backrest to the back of the user, the pliable backrest includes a pliable material extending between the support face and the coupling face of the pliable backrest, the coupling face coupled with an upright extending from the seat, and deforming the pliable backrest from the support face to the coupling face during reclining of the pliable backrest.

Example 35 can include, or can optionally be combined with the subject matter of Examples 1-34 to optionally include wherein deforming the pliable backrest includes at least partially filling a deformation gap between the pliable backrest and the upright with the pliable material of the pliable backrest.

Example 36 can include, or can optionally be combined with the subject matter of Examples 1-35 to optionally include wherein supporting the back of the user with the pliable backrest includes: compressing or expanding one or more pliable pillars extending from the pliable backrest to the upright, the one or more pliable pillars include the pliable material.

Example 37 can include, or can optionally be combined with the subject matter of Examples 1-36 to optionally include remotely supporting the pliable backrest from the upright with one or more pliable pillars extending from the upright, the one or more pliable pillars include the pliable material.

Example 38 can include, or can optionally be combined with the subject matter of Examples 1-37 to optionally include wherein the pliable back rest includes a back contour plane along the coupling face with engagement of the pliable backrest to the back of the user, and deforming the pliable backrest includes recessing at least a portion of the pliable material proximate the coupling face relative to the back contour plane and toward the upright.

Example 39 can include, or can optionally be combined with the subject matter of Examples 1-38 to optionally include wherein supporting the back of the user with the pliable backrest includes supporting the back of the user with the pliable backrest and a pivoting upright.

Example 40 can include, or can optionally be combined with the subject matter of Examples 1-39 to optionally include wherein the pivoting upright includes a joint assembly having a pivot and opposed stop interfaces, and supporting the back of the user with the pliable backrest and the pivoting upright includes: rotating a first upright portion of the upright relative to a second portion at the pivot with reclining of the pliable backrest, and bracing the first upright portion with engagement between the opposed stop interfaces.

Example 41 can include, or can optionally be combined with the subject matter of Examples 1-40 to optionally include wherein the pivoting upright includes a joint assembly having a pivot and opposed stop interfaces, and supporting the back of the user with the pliable backrest and the pivoting upright includes: rotating a first upright portion of the upright relative to a second portion at the pivot in a first arc, and the opposed stop interfaces are disengaged, rotating the first upright portion relative to the second portion in a second arc greater than the first art, and the opposed stop interfaces are engaged, and bracing the first upright portion with the engaged opposed stop interfaces in the second arc.

Example 42 can include, or can optionally be combined with the subject matter of Examples 1-41 to optionally include wherein the pivoting upright includes a joint assembly having a pivot and opposed stop interfaces, and supporting the back of the user with the pliable backrest and the pivoting upright includes: gradually engaging the opposed stop interfaces with rotation of a first upright portion of the upright relative to a second portion at the pivot, and bracing of the first upright portion proportionally to the rotation of the first upright portion and gradual engagement of the opposed stop interfaces.

Example 43 can include, or can optionally be combined with the subject matter of Examples 1-42 to optionally include wherein supporting the back of the user with the pliable backrest includes: supporting the twisting of the back with lateral wings of the pliable backrest, the lateral wings include the pliable material.

Example 44 can include, or can optionally be combined with the subject matter of Examples 1-43 to optionally include wherein supporting twisting of the back with the lateral wings includes bracing the lateral wings with a pliable frame extending along perimeters of the lateral wings, the pliable frame includes the pliable material.

Example 45 can include, or can optionally be combined with the subject matter of Examples 1-44 to optionally include wherein the upright includes an elastic upright, and comprising supporting the back of the user with the elastic upright including correspondingly deforming the elastic upright to deformation of the pliable backrest.

Example 46 can include, or can optionally be combined with the subject matter of Examples 1-45 to optionally include wherein the upright includes an elastic upright, and comprising supporting the back of the user with the elastic upright including helically twisting the elastic upright.

Example 47 can include, or can optionally be combined with the subject matter of Examples 1-46 to optionally include a method for assembling a seating assembly comprising: seating a pivot of an upright bracket within a pivot socket of a base housing, the upright bracket rotatable relative to the base housing at the pivot; positioning an unloaded biasing element between a proximate element anchor of the base housing and the pivot; and preloading the biasing element according to a transition from a passive preloading configuration to a preloaded configuration, preloading includes: coupling a seat pan with the base housing, the upright bracket and the biasing element spacing the seat pan from the base housing in the passive preloading configuration, fastening the seat pan with the base housing including translating the seat pan toward the base housing, and closing the spacing between the seat pan and the base housing according to the fastening, and closing the spacing automatically preloads the biasing element to the preloaded configuration.

Example 48 can include, or can optionally be combined with the subject matter of Examples 1-47 to optionally include wherein preloading the biasing element includes rotating the upright bracket to couple a distal element anchor of the upright bracket with an element distal portion of the biasing element remote from the pivot in the passive preloading configuration.

Example 49 can include, or can optionally be combined with the subject matter of Examples 1-48 to optionally include wherein automatically preloading the biasing element includes deflecting the biasing element.

Example 50 can include, or can optionally be combined with the subject matter of Examples 1-49 to optionally include wherein preloading the biasing element includes anchoring the biasing element within one or more of the base housing or the upright bracket.

Example 51 can include, or can optionally be combined with the subject matter of Examples 1-50 to optionally include wherein coupling the seat pan with the base housing includes capturing the biasing element with one or more of the base housing or the upright bracket.

Example 52 can include, or can optionally be combined with the subject matter of Examples 1-51 to optionally include wherein closing the spacing between the seat pan and the base housing automatically preloads the biasing element to a specified preload.

Example 53 can include, or can optionally be combined with the subject matter of Examples 1-52 to optionally include coupling an upright having a pliable backrest with the upright bracket.

Example 54 can include, or can optionally be combined with the subject matter of Examples 1-53 to optionally include wherein preloading the biasing element precedes coupling the upright with the upright bracket.

Example 55 can include, or can optionally be combined with the subject matter of Examples 1-54 to optionally include wherein coupling the upright having the pliable backrest includes coupling the upright having the pliable backrest with pliable material extending continuously between support and coupling faces.

Aspect 56 can include, or can optionally be combined with the subject matter of Aspects 1-55 to optionally include a preloaded seating assembly comprising: a seat pan having a seating surface; a base housing coupled with the seat pan, the base housing includes: a proximal strut anchor; and a pivot socket proximate to the proximal strut anchor; an upright bracket having a pivot hub seated in the pivot socket of the base housing and rotatable relative to the base housing, the upright bracket includes a distal strut anchor spaced from the pivot hub; a biasing strut having first and second ends, the biasing strut coupled between the pivot hub and the proximal strut anchor proximate the first end, the biasing strut proximate the second end engaged against the upright bracket at the distal strut anchor; and wherein the biasing strut is configured to transition between a passive loaded configuration and a preloaded configuration: in the passive loaded configuration the second end of the biasing strut spaces the seat pan from the base housing by a preload spacing; and in the preloaded configuration the seat pan is engaged with the base housing, and engagement of the seat pan with the base housing closes the preload spacing and preloads the biasing strut to a specified preload value.

Aspect 57 can include, or can optionally be combined with the subject matter of Aspects 1-56 to optionally include wherein pivot hub is a fulcrum for the biasing strut between the first and second ends.

Aspect 58 can include, or can optionally be combined with the subject matter of Aspects 1-57 to optionally include wherein the pivot hub is engaged against a first surface of the biasing strut, and proximal and distal strut anchors are engaged against a second surface of the biasing strut opposed to the first surface.

Aspect 59 can include, or can optionally be combined with the subject matter of Aspects 1-58 to optionally include wherein the pivot hub is proximate to the first end and the proximal strut anchor and remote from the second end and the distal strut anchor.

Aspect 60 can include, or can optionally be combined with the subject matter of Aspects 1-59 to optionally include wherein the biasing strut includes one or more biasing elements.

Aspect 61 can include, or can optionally be combined with the subject matter of Aspects 1-60 to optionally include wherein the one or more biasing elements include one or more leaf springs.

Aspect 62 can include, or can optionally be combined with the subject matter of Aspects 1-61 to optionally include wherein in the passive loaded configuration the biasing strut includes a linear profile between the first and second ends; and in the preloaded configuration the biasing strut includes a curved profile relative to the linear profile between the first and second ends.

Aspect 63 can include, or can optionally be combined with the subject matter of Aspects 1-62 to optionally include seat pan fasteners, and the seat pan fasteners engage the seat pan with the base housing in the preloaded configuration.

Aspect 64 can include, or can optionally be combined with the subject matter of Aspects 1-63 to optionally include a backrest coupled with an upright member, and the upright member is coupled with the upright bracket proximate to the biasing strut second end and the distal strut anchor.

Aspect 65 can include, or can optionally be combined with the subject matter of Aspects 1-64 to optionally include wherein the backrest includes a pliable backrest having a pliable material extending between support and coupling faces of the pliable backrest.

Each of these non-limiting examples can stand on its own, or can be combined in various permutations or combinations with one or more of the other examples.

The above detailed description includes references to the accompanying drawings, which form a part of the detailed description. The drawings show, by way of illustration, specific embodiments in which the disclosure can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between tins document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms 'including" and "comprising" are open-ended, that is, a system, device, article, composition, formulation, or process that includes elements in addition to those listed after such a term in a claim are still deemed to fail within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the disclosure should be determined with reference to the appended claims, along with the full scope of equivalents to which such claims are entitled.

What is claimed is:

1. A seating assembly comprising:
a seat;
an upright member coupled to the seat and extending away from the seat; and
a pliable backrest coupled to the upright member for providing deflectable support, the pliable backrest comprising:
a support face;
a coupling face spaced away from the upright member such that a deformation gap is formed between the pliable backrest and the upright member;
a pliable material extending continuously between the support face and the coupling face,
wherein the pliable material comprises an elastomeric foam configured to be depressed and/or deformed; and
at least one lateral wing extending from the upright member.

2. The seating assembly of claim 1, wherein the at least one lateral wing comprises a pliable frame extending along an outer perimeter of the pliable backrest and comprising the pliable material.

3. The seating assembly of claim 1, wherein the upright member further comprises a joint assembly, said joint assembly comprising:
a first upright end portion;
a second upright end portion that is positioned above the first upright end portion; and
a rotatable pivot joining the first upright end portion to the second upright end portion and facilitating deflection of the joint assembly.

4. The seating assembly of claim 3, wherein the joint assembly further comprises a stop having one or more engaging surfaces configured to support the rotatable pivot during rotation.

5. The seating assembly of claim 4, wherein the stop comprises at least one stop interface for providing counterforces according to a reclination of the seating assembly.

6. The seating assembly of claim 1, wherein the support face is deformable into a plurality of configurations corresponding to a respective plurality of contours of a user's back.

7. A seating assembly comprising:
a seat;
an upright member coupled to the seat and extending away from the seat,
wherein the upright member further comprises a joint assembly, said joint assembly comprising:
a first upright end portion;
a second upright end portion that is positioned above the first upright end portion; and
a rotatable pivot joining the first upright end portion to the second upright end portion and facilitating deflection of the joint assembly,
a stop having one or more engaging surfaces configured to support the rotatable pivot during rotation; and
a pliable backrest coupled to the upright member for providing deflectable support, the pliable backrest comprising:
a first exterior face;
a second exterior face; and
a pliable material extending continuously between the first exterior face and the second exterior face.

8. The seating assembly of claim 7, wherein:
the first exterior face is a support face for supporting a back of a user; and
the second exterior face is a coupling face spaced away from the upright member such that a deformation gap is formed between the pliable backrest and the upright member.

9. The seating assembly of claim 7, wherein the pliable backrest is configured to deform into a plurality of configurations corresponding to a respective plurality of contours of a user's back.

10. The seating assembly of claim 9, wherein the plurality of configurations comprises at least one of reclining, tilting, twisting, or rotating of the pliable backrest.

11. The seating assembly of claim 9, wherein:
the pliable backrest further comprises at least one vertical wing and at least one lateral wing; and
deformation of the pliable backrest includes deformation of one or more of the at least one vertical wing and the at least one lateral wing.

12. The seating assembly of claim 7, wherein the stop comprises opposed stop interfaces, wherein the first upright end portion is rotatable relative to the second upright end portion at the rotatable pivot in a first arc such that the opposed stop interfaces are disengaged, and wherein the first upright end portion is rotatable relative to the second upright end portion at the rotatable pivot in a second arc greater than the first arc such that the opposed stop interfaces are engaged to brace the first upright end portion.

13. The seating assembly of claim 7, further comprising one or more pliable pillars extending from the pliable backrest to the upright member, wherein the one or more pliable pillars include the pliable material.

14. A method for supporting a user in a seating assembly comprising:

supporting a posterior of the user in a seat of the seating assembly;

supporting a back of the user with a pliable backrest of the seating assembly coupled to an upright member of the seating assembly, wherein the pliable backrest comprises:

a support face;

a coupling face coupled to the upright member;

a pliable material extending continuously between the support face and the coupling face, wherein the pliable material comprises an elastomeric foam configured to be depressed and/or deformed; and one or more lateral wings comprising the pliable material and extending from the upright member;

deforming the pliable backrest according to a contour of the user's back when the user is supported thereon; and supporting a twisting motion of the user's back using the one or more lateral wings when the user is supported thereon and initiates said twisting motion.

15. The method of claim 14, wherein the coupling face is spaced away from the upright member such that a deformation gap is formed between the pliable backrest and the upright member.

16. The method of claim 15, wherein the pliable backrest deflects to decrease the deformation gap between the pliable backrest and the upright member.

17. The method of claim 14, wherein supporting the back of the user with the pliable backrest comprises:

compressing or expanding one or more pliable pillars, wherein said one or more pliable pillars extend from the pliable backrest to the upright member, and wherein the one or more pliable pillars include the pliable material.

18. The method of claim 14, further comprising: rotating the upright member at a rotatable pivot joint of the upright member.

19. The method of claim 14, wherein supporting the twisting motion of the user's back using the one or more lateral wings comprises:

bracing a plurality of lateral wings with a respective plurality of pliable frames extending along perimeters of the plurality of lateral wings, wherein the plurality of pliable frames comprise the pliable material.

20. The seating assembly of claim 1, wherein the at least one lateral wing supports a twisting motion of the user's back when the user is supported thereon and initiates said twisting motion.

* * * * *